US005759103A

United States Patent [19]

Freels et al.

[11] Patent Number: 5,759,103

[45] Date of Patent: Jun. 2, 1998

[54] APPARATUS FOR COLLECTING AND PROCESSING VIDEO SLOT TRANSACTIONS

[75] Inventors: Jack D. Freels, Penryn; Kevin A. Freels, Granite Bay; Edmund B. McGranaghan, Sacramento, all of Calif.

[73] Assignee: New Gaming Systems, Inc., Sacramento, Calif.

[21] Appl. No.: 620,442

[22] Filed: Mar. 22, 1996

[51] Int. Cl.[6] ..... A63F 9/24

[52] U.S. Cl. ..... 463/42

[58] Field of Search ..... 463/25, 29, 16, 463/40, 41, 42

[56] References Cited

U.S. PATENT DOCUMENTS

| | | | |
|---|---|---|---|
| 3,790,719 | 2/1974 | Montague et al. . | |
| 4,072,930 | 2/1978 | Lucero et al. . | |
| 4,108,361 | 8/1978 | Krause . | |
| 4,283,709 | 8/1981 | Lucero et al. . | |
| 4,636,951 | 1/1987 | Harlick . | |
| 4,964,638 | 10/1990 | Ishida . | |
| 5,007,649 | 4/1991 | Richardson | 463/25 |
| 5,116,055 | 5/1992 | Tracy . | |
| 5,179,517 | 1/1993 | Sarbin et al. | 463/25 |
| 5,324,035 | 6/1994 | Morris et al. | 463/42 |
| 5,386,995 | 2/1995 | Takemoto et al. . | |
| 5,429,361 | 7/1995 | Raven et al. . | |

*Primary Examiner*—George Manuel
*Attorney, Agent, or Firm*—John P. O'Banion

[57] ABSTRACT

An apparatus for collecting and processing payout vouchers from video slot machines, in which one or more cashier stations are networked to a cage server, which in turn communicates with a vault processor and a slot accounting processor. Software layers provide for tracking point of transaction payout information, accumulating and reporting drop figures from the cashier stations, and pulling data from the vault and cages, auditing the vouchers, reconciling the data, updating files and providing management with reports.

7 Claims, 3 Drawing Sheets

APPARATUS FOR COLLECTING AND PROCESSING VIDEO SLOT TRANSACTIONS

NOTICE OF MATERIAL SUBJECT TO COPYRIGHT PROTECTION

A portion of the disclosure of this patent document contains material which is subject to copyright protection. The copyright owner has no objection to the facsimile reproduction by any one of the patent document or the patent disclosure, as it appears in the U.S. Patent and Trademark Office file or records, but otherwise reserves all copyrights therein.

BACKGROUND OF THE INVENTION

1. Field of the Invention

The present invention pertains generally to systems and devices for monitoring, collecting and processing casino transactions, and more particularly to a transaction point collecting and processing apparatus for video slot machines which print payout vouchers as opposed to dispensing cash.

2. Description of the Background Art

It is commonly known to produce Class II type video slot machines in which a winning player receives a printed voucher instead of coins or tokens. It is also known to connect video slot machines and other gaming devices in an installation to a central computer system which can interrogate each machine in the system to gather audit data collected by the machines during their normal course of operation. For example, U.S. Pat. No. 4,283,709 issued to Lucero et al. on Aug. 11, 1981 a computerized accounting system for slot machines in which each slot machine is connected to a node in a computer network for transferring data. U.S. Pat. No. 4,636,951 issued to Harlick on Jan. 13, 1987. This patent discloses a computer system which is connected to poker machines for transferring accounting information and which can be used for video machines.

SUMMARY OF THE INVENTION

In contrast to "on-line" computerized accounting systems which are in current use, the present invention generally comprises a transaction point collection and processing apparatus for video slot machines which is not physically connected to the slot machines. By way of example, and not of limitation, the invention includes one or more cashier or "cage" stations connected to a network and hosted by a cage server, a vault processor, and a slot accounting processor for its hardware layer, and cashier, drop, and slot accounting software layers or modules. Each cashier station generally comprises a personal computer or the like, having a keyboard, a monitor, random access memory, a mass storage device, and a network communications interface. The cage server, vault processor and slot accounting processor are also personal computers or the like having similar hardware configurations as the cashier stations, except that they also include printers. Payout information is accumulated by the cage server from the "point of transaction" cashier stations through the cashier software layer. The drop software layer provides for accumulating and reporting all of the slot machine drop figures from the cashier stations, and the slot accounting software layer provides for pulling data from the vault and cages, auditing the vouchers, reconciling the data, updating files and providing management with reports.

An object of the invention is to provide for transaction point collection and processing of printed vouchers representing winnings from video gaming machines.

Another object of the invention is to provide casino management and accounting personnel with a tool for handling the abundance of data generated by video gaming machines.

Another object of the invention is to provide for an easy flow of information from the cage to the vault to the slot accounting office in a casino.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 2:
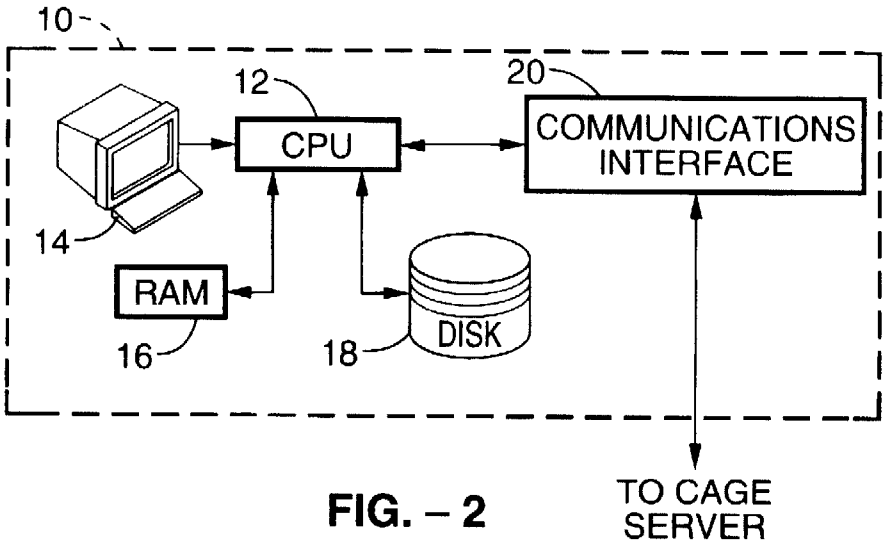
FIG. 2 is a functional block diagram of a cashier station shown in FIG. 1.

Referring more specifically to the drawings, for illustrative purposes the present invention is embodied in FIG. 1 through FIG. 6, where like reference numerals denote like parts. It will be appreciated, however, that the apparatus may vary as to configuration and as to details of the components and functions without departing from the basic concepts as disclosed herein.

Figure 1:
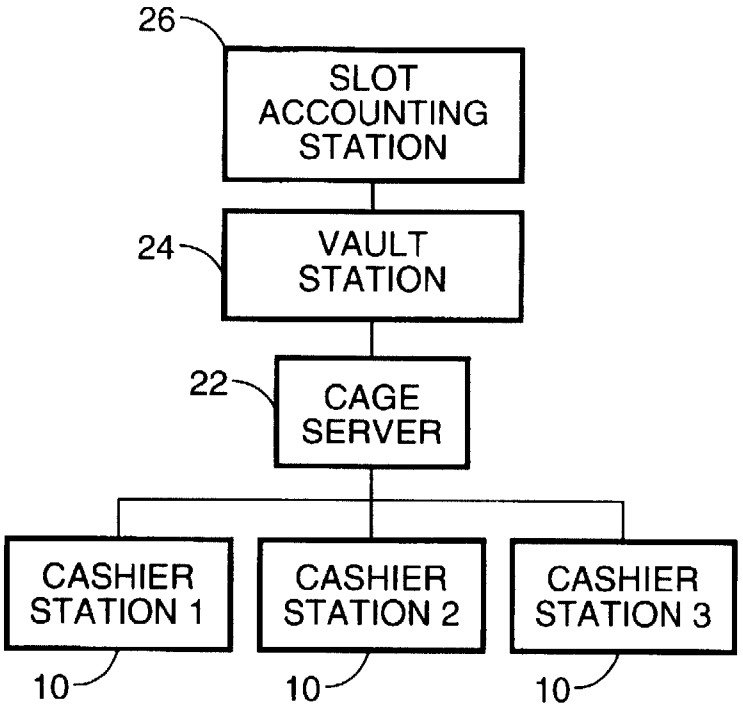
FIG. 1 is a functional block diagram showing the hardware layer of an apparatus in accordance with the present invention.

Referring first to FIG. 1 and FIG. 2, the hardware layer of a video slot transaction collecting and processing apparatus in accordance with the present invention comprises one or more cashier stations 10. Each cashier station 10 generally includes a central processing unit 12 which is operatively coupled to a user interface 14, random access memory 16, a physical storage device 18, and a communications interface 20. Central processing unit 12 is typically a 486- or Pentium-based programmable data processor or the like, with conventional input/output interfaces. User interface 14 is typically a conventional keyboard and video display, providing means for accessing central processing unit 12. Random access memory 16 is typically high speed memory which is used for storing application programs at run time, as well as for storing and manipulating data files. Physical storage device 18 is typically a fixed disk drive or the like, upon which the operating system, application programs, and data files are stored. Communications interface 20 is typically a network communications input/output device, such as an Ethernet® adapter. Those skilled in the art will appreciate that other hardware devices could be substituted for those described above, and that cashier station 10 could include other peripheral devices.

Each cashier station 10 is hosted by a cage server 22 through network interface 20. The network is preferably connected via either thin coaxial or 10Base-2 twisted pair cable with either BNC or RJ45 connectors. Cage server 22, vault station 24, and slot accounting station 26 generally comprise the same hardware as a cashier station 10, except that they also preferably include a printer. Further, cage server 22 may also include additional network software, processing capability, and memory to support its function as a network server. The invention employs conventional hardware components, as well as conventional network and communications software for the elements described above.

As can be seen, cashier stations 10 slave off the cage server 22 where payout information is accumulated at the point of transaction. The vault station 24 accumulates income information; that is, the "drop". The slot accounting station 26 has access to the cage server 22 and vault station 24 through conventional communications interfaces, but neither the cashier stations 10 nor the vault station 24 have access to the slot accounting station 26 for security reasons, since all income and payout information is audited, reconciled and made permanent by slot accounting station 26 as described below. It will also be appreciated that, while three cashier stations 10 are shown in FIG. 1, the number of cashier stations is not limited to three.

Figure 3:
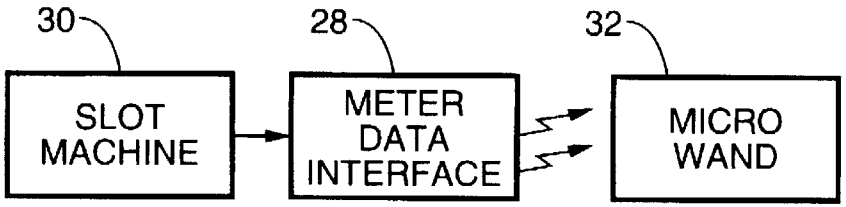
FIG. 3 is a functional block diagram showing an infrared data collection system in accordance with the present invention.

An optional feature of the invention is shown in FIG. 3. If desired, an infrared transducer/data interface 28 can be attached to a slot machine 30 to replace the conventional total-in and total-out meters. Each data interface 28 would have a unique identification number that identifies a particular slot machine. At the time of a drop, an infrared microwand 32 is used to read the meters and identification numbers from data interface 28, and to store the data for downloading and reconciliation. The data can be downloaded to a cashier station, vault station or slot accounting station using conventional communications software.

Figure 4:
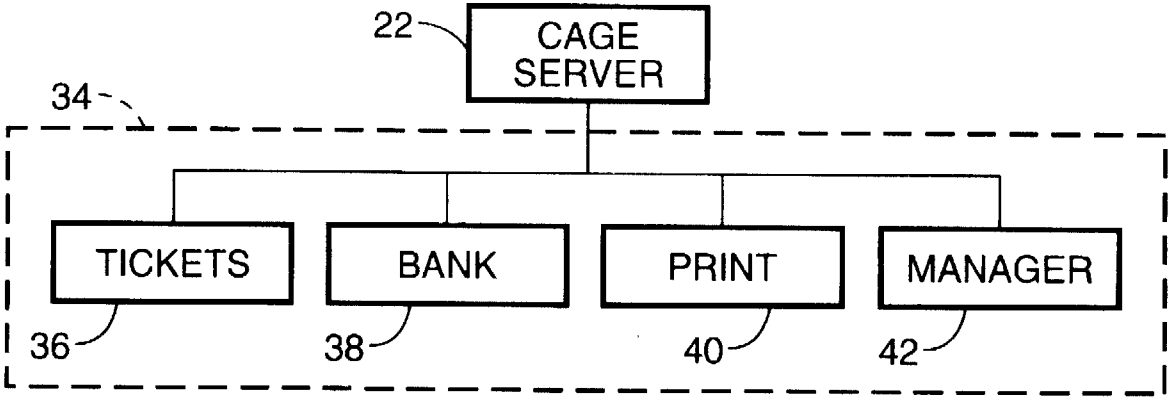
FIG. 4 is a functional block diagram showing the cashier software layer of an apparatus in accordance with the present invention.

Referring also to FIG. 4, the invention includes a cashier software layer or module 34 which runs each cashier station 10. Cashier software layer 34 is executed on cage server 22, where there is one such layer for each cashier station 10. The cashier software layer 34 provides a menu driven user interface which is invoked by a conventional password protected sign-on script. Once cage software layer 34 is accessed in this manner, the menu provides access to four functional sublayers: tickets 36, bank 38, print 40, and manager 42. The tickets sublayer 36 allows the cashier to add up and manually enter vouchers as they are being redeemed by customers at the point of transaction. This sublayer also allows cashiers to lookup all of their transactions since sign-on, modify any errors made during entry, and update the cash balance of their drawer. The bank sublayer 38 allows the cashier to manually enter any cash fills to his or her drawer and automatically update the drawers' balance, as well as to enter any table chips that customers have cashed-in. The print sublayer 40 allows a cashier to acquire either a transaction report or a voucher report. The transaction report is a table listing date and time the cashier signed on the system with the original drawer balance in addition to the date and time any transaction was performed by the cashier with a running drawer balance. The voucher report is a table listing by machine number the number of vouchers and total cash amount for every machine that the particular cashier has paid out. The manager sublayer 42 allows certain cashiers to generate day, swing and graveyard reports for all cashiers and also to perform an end of business day closeout function which gives preliminary reports on the days business while saving critical payout information to be retrieved across the network from the slot accounting station 26.

In the preferred embodiment, the data structures used in cashier software layer 34 are Paradox® 4.5 DOS based db tables or the like. All scripts and tables are brought together and then compiled into an executable program using Turbo Pal® or the like as the compiler. Exemplary software for implementing cashier software layer 34 is set forth in Appendix A hereto. The following is a list of major tables manipulated by the cashier software sublayer.

| | |
|---|---|
| Cashier.db | this table stores information specific to cashiers, and contains cashier numbers, names, passwords, transaction tables and backup transaction tables. |
| Onoflogn.db | where n represents the cashier station, this table contains dates and times cashiers signed on and off of the "nth" cashier station. |
| Ticksn.db | where n represents a particular cashier's number, this table contains the "nth" cashier's transaction file. At the close of the business day, this file is backed up as Tkn.db and then emptied so that the next time the cashier signs on they have a fresh transaction table. |
| Shiftn.db | where n represents the station number, this table is generated whenever a particular cashier requests a voucher report. |
| Currentn.db | a small table containing the name of the transaction table being used by the "nth" station. |
| Coyote.db | This table contains machine information. |
| Addn.db | This is an input table for entering either cash fills or chips at the "nth" cashier station. |
| Multkn.db | This table is used to store and process multiple vouchers. |

Figure 5:
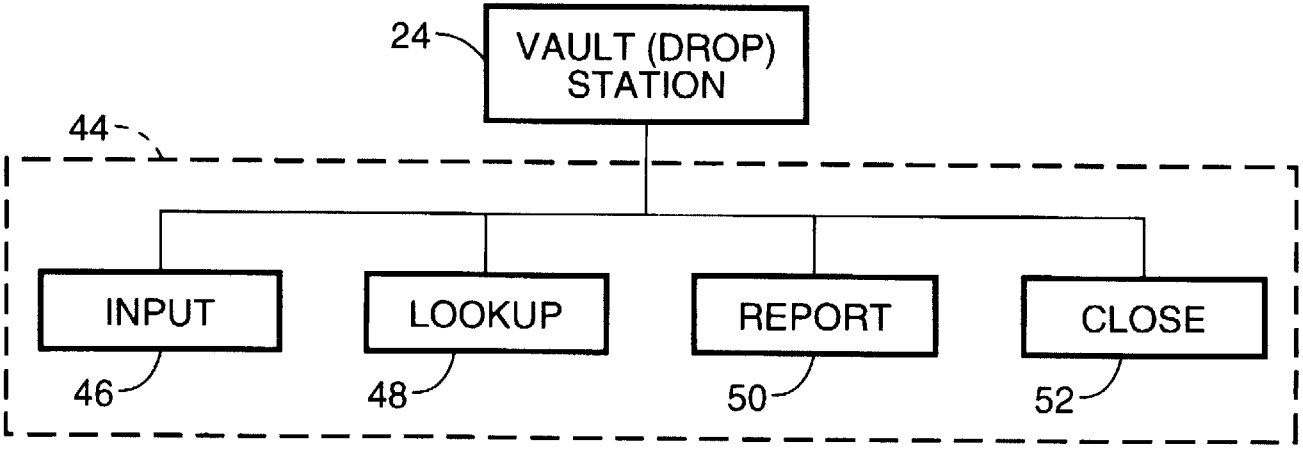
FIG. 5 is a functional block diagram showing the drop software layer of an apparatus in accordance with the present invention.

Referring now to FIG. 5, vault station 24 includes a drop software layer 44 which assists vault personnel counting the drop per machine. Drop software layer 44 can be executed on either vault station 24 or the cage server 22. Drop software layer 44 comprises four functional sublayers: input 46, lookup 48, report 50 and close 52. The input sublayer 46 allows the user to manually input drop currency amounts of ones, twos, fives, tens, twenties, etc. per slot machine, calculate and record totals. The lookup sublayer 48 allows the user to lookup the daily totals per machine. The report sublayer 50 prints a report on machine drop activity for the current days work. The close sublayer 52 saves the day's drop activity to a file and zeroes out totals for the next days processing. Exemplary software for implementing the drop software layer 44 is set forth in Appendix B.

There are two main data objects that are manipulated by the drop software layer 44.

| | |
|---|---|
| Dropent.db | An entry table for users to enter amounts and to be calculated. |
| Droptab.db | The table that dropent.db writes to which provides the report and permanent days document. |

It will also be appreciated, however, that a conventional currency counting apparatus could be included with the present invention, and that such currency counters include software which will export the count information to an ASCII file or the like. In that event, the drop software layer can be modified to import this information.

Figure 6:
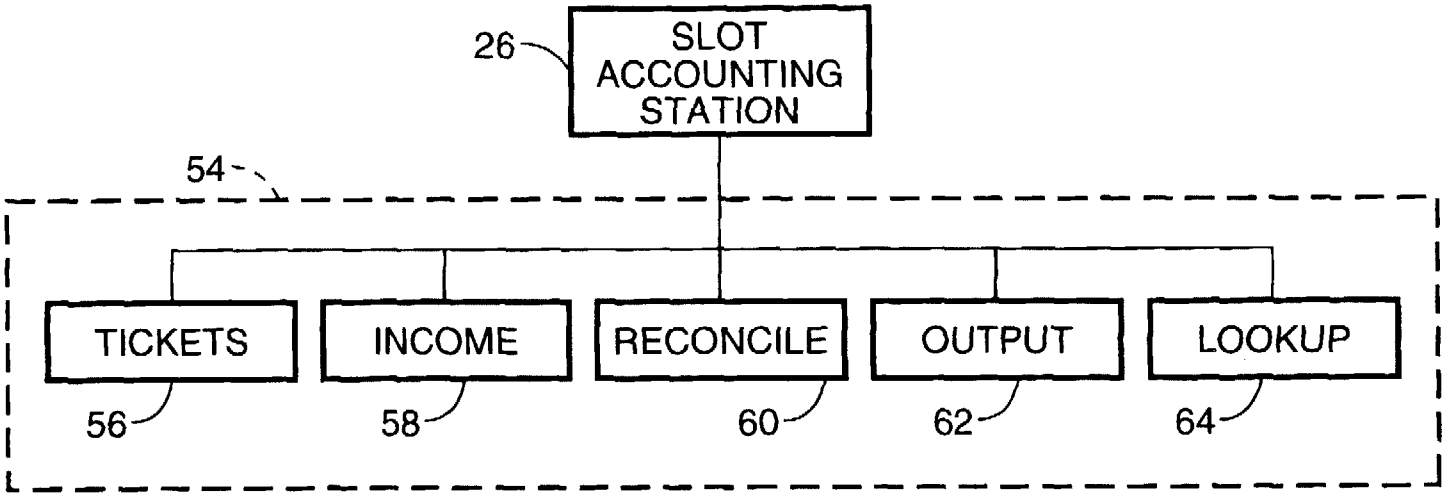
FIG. 6 is a functional block diagram showing the slot accounting software layer of an apparatus in accordance with the present invention.

Referring to FIG. 6, the invention also includes a slot accounting software layer 54 which assimilates the data collected in the cage and vault, verifies the data, reconciles the data, provides critical management reports and helps insure the integrity of the data so eventually the data can be mapped to the casino's general ledger. Slot accounting software layer 54 comprises the following five functional sublayers: tickets 56, income 58, reconcile 60, output 62 and lookup 64. The tickets sublayer 56 allows the slot accountant to load transaction files across the network from the cashier stations 10, physically audit the payout vouchers, and provide final daily reports on both cashiers and machines payout activity. The income sublayer 58 allows users to load the daily drop file from across the network, manually or electronically via microwand 32, input meter readings and provide a daily drop report. In addition, a significant aspect of this sublayer is that it builds a critical table for the day used for almost all further processing. This file contains daily meter readings, drop, payout and net amount per machine. The file is saved by the user using a naming convention such as "Fileddmm" where dd and mm represent day and month of the year respectively; this, the data collected from the cage and vault and meter readings have been assimilated into one file for reconciliation. The reconcile sublayer 60 allows the slot accountant to load the critical table referred to above into memory along with the previous days meter readings from the master file, perform the various calculations necessary to run a reconciliation and give variances. This sublayer also allows the user to make necessary changes to the master file, update to current meter readings and build and maintain a daily totals file for machine activity in the casino. The output sublayer 62 allows the user to generate four different types of reports. A periodic summary report can be generated for any period of time as requested by the user; this table contains date, total-in, total-out, net and payout percentage for each day requested along with a bottom line representing the total for the requested period. A machine income status report can be generated which gives daily, week to date, month to date, and year to date income and percentages per machine. An analysis report can be generated giving income information by machine type, denomination or by banks of machines. A machine flag report will flag losing machines over a specified period of time. Lastly, the lookup sublayer 64 allows the user to lookup machine income, daily totals or view the machine master file.

Exemplary software for implementing the slot accounting software layer 54 is set forth in Appendix C. The following tables are either read or manipulated by the slot accounting software layer 54.

| | |
|---|---|
| Askem.db | an input table prompting the user for a specified date for periodic reports. |
| Bigcyot.db | a data table containing a machine income history for all machines in the casino. |
| Cashier.db | a table containing cashier information similar to that in the cashier program. |
| Cashrep.db | a table generated for summarizing daily cashier payout information. |
| Convert.db | a prompt table asking the user which file they want to load across the network. |
| Coyote.db | the machine master file containing latest information regarding machine types, denominations, ID numbers, and latest known meter readings. |
| Cyotanls.db | a table generated when an analysis is requested by the user. |
| Cyotpcnt.db | the table manipulated when an income status report is requested. |
| Daily.db | the table generated to be saved as the "Fileddmm" referred to above under the income sublayer 58. |
| Droprep.db | a table providing a daily drop report. |
| Droptab.db | the final daily drop table. |
| Endshift.db | this table provides a final verified voucher report. |
| Flagrep.db | this table is generated when a flag report is requested. |
| Location.db | table containing information specific to the casino. |
| M&m.db | a "money and meters" table read by the reconcile sublayer 60. |
| Meters.db | a table for entering meter readings. |
| Shiftrep.db | a table generated when printing a voucher report for an individual cashier. |
| Sumfile.db | a table generated when a periodic summary report is requested. |
| Tabrep.db | a table containing all reconciliations for all dates machines were reconciled. |
| Tabup.db | a buffer table used when updating the machine master file. |
| Temprec.db | the table generated when running a reconciliation; this table is added to Tabrep.db upon updating the master file. |
| Ticksn.db | as with the cashier program, this table is the transaction file for the cashier whose number is n. |
| Totrep.db | this table contains daily totals for all machines. |
| Type.db | a table containing information specific to machine types. |

The apparatus of the invention is typically operated in accordance with the following method at the beginning of a day. After the graveyard shift has run a final closing, daytime cashiers will come on shift and sign-on to the to the system by typing "go" to invoke a simple batch program that launches the cashier software layer 34. The cashier is then prompted for his or her cashier number, password, and beginning drawer balance. If the cashier number and password are valid, cashier software layer 34 executes fully and the cashier simply enters vouchers, fills, chips cashed etc. until the end of the shift. At that time, the cashier signs off and the cashier for the swing shift takes over in similar fashion. Meanwhile the vault crew is usually working early hours in the morning counting the drop from the machines. The operator of the vault station 24 types "drop" to invoke a simple batch program that launches the vault station software layer. The operator inputs all the machine drop figures, gets a report and closes the activity for the day. At the same time, the slot accountant can operate slot accounting station 26, pull data from the vault and cages, audit the vouchers, reconcile the data, update files and provide management with reports. It will be appreciated, however, that different casinos will vary in the method in which the invention is used, and that the exemplary method of operation described above is not a critical aspect of the invention.

Although the description above contains many specificities, these should not be construed as limiting the scope of the invention but as merely providing illustrations of some of the presently preferred embodiments of this invention. Further, those skilled in the art will appreciate that software can be written in many different ways to implement the functional layers and sublayers described herein. Thus the scope of this invention should be determined by the appended claims and their legal equivalents.

APPENDIX A

NGS VSIS PROGRAM

8/23/95 List of PAL scripts for a single cashier station. Page 1
Copyright 1995 New Gaming Systems Inc.

| Script Name | Description |
|---|---|
| Addbank1 | Allows cashier to record fills. |
| Cashchp1 | Allows cashier to register table chips cashed. |
| Cashier1 | This script provides the menu that launches all other scripts except for Signon1. |
| Change1 | This script allows the cashier to modify thier transaction file. |
| Dltran1 | Designs cashiers transaction report. |
| Dlvouch1 | Designs cashier voucher payout report. |
| Dshift1 | Runs a dayshift report. |
| Extra1 | Allows cashier to calculate an record multiple transactions. |
| Fclose1 | Closes out daily cashier activity and saves all data. |
| Gshift1 | Runs Grave shift report. |
| Lookup1 | Allows cashier to view their transaction file. |
| Outshift | Sends final cashier summary report. |
| Prnshft1 | Prints cashiers voucher payout report. |
| Prntran1 | Prints cashier transaction report. |
| Promptm1 | Allows cashier to record single voucher transactions. |
| Signoff1 | Allows cashier to signoff for the day. |
| Signon1 | Allows cashier to signon for the day then invokes the Cashier script. |
| Sshift1 | Runs swing shift report. |

A:\addbank1.sc Page 1

```
;*********************************************************************
;                              ADDBANK1.SC
;
; allows cashier to add cash to bank
;Copyright 1995 New Gaming Systems Inc.
;*********************************************************************

EMPTY "ADD1"                    ;empty input table
EDIT "ADD1"                     ;auto entry of date and time
[Date]=TODAY()                  ;prompt user for correct addition amount
[Time]=TIME()                   ;until user presses F2
PICKFORM "1"
MOVETO [Amount-Added]
WAIT RECORD
PROMPT "Enter correct amount added to bank then press F2"
UNTIL "F2"
DO_IT!
DAT1=[Date]
TIME1=[Time]
IF ISBLANK([Amount-Added]) THEN
  AMTADD1=0
  ELSE AMTADD1=[Amount-Added]
ENDIF
CLEARALL
VIEW "CURRENT1"                  ;now get cashiers transaction file
FNAME1=[File-Name]               ;enter date time transaction code
CLEARALL                         ;update balance and return to
VIEW FNAME1                      ;main menu
END
BAL1=[Balance]

EDIT FNAME1
END DOWN
[Date]=DAT1
[Time]=TIME1
[Transaction-Code]="B"
[Verification-#]="Bank Add"
[Amount-Paid]=0
[Amount-Added]=AMTADD1
[Balance]=BAL1+AMTADD1
NEWBAL1=[Balance]
DO_IT!
CLEARALL
MESSAGE "New Bank Balance is ",NEWBAL1

SLEEP 2000
RELEASE VARS DAT1,TIME1,AMTADD1,FNAME1,BAL1,NEWBAL1
```

A:\cashchp1.sc Page 1

```
;*********************************************************************
;                          CASHCHP1.SC
;
;allows cashier to cash table chips
;Copyright 1995 New Gaming Systems Inc.
;*********************************************************************

EMPTY "ADD1"                    ;empty input table
EDIT "ADD1"                     ;auto entry of date and time
[Date]=TODAY()                  ;prompt user for correct addition amount
[Time]=TIME()                   ;until user presses F2
PICKFORM "2"
MOVETO [Amount-Added]
WAIT RECORD
PROMPT "Enter correct amount of chips cashed then press F2"
UNTIL "F2"
DO_IT!
DAT1=[Date]
TIME1=[Time]
AMTADD1=[Amount-Added]
CLEARALL
VIEW "CURRENT1"                  ;now get cashiers transaction file
FNAME1=[File-Name]               ;enter date time transaction code
CLEARALL                         ;update balance and return to
VIEW FNAME1                      ;main menu
END
BAL1=[Balance]

EDIT FNAME1
END DOWN
[Date]=DAT1
[Time]=TIME1
[Transaction-Code]="C"
[Verification-#]="Chip Buy"
[Amount-Paid]=0
[Amount-Added]=AMTADD1
[Balance]=BAL1
NEWBAL1=[Balance]
DO_IT!
CLEARALL
MESSAGE "Bank Balance including table chips is ",NEWBAL1

SLEEP 2000
RELEASE VARS DAT1,TIME1,AMTADD1,CURRENT1,FNAME1,BAL1,NEWBAL1
```

A:\cashier1.sc Page 1

```
;*********************************************************************
;                      CASHIER1 SCRIPT
;
;this script provides the main menu for the number 1 cashier
;Copyright 1995 New Gaming Systems Inc.
;*********************************************************************
;                          MAIN
;*********************************************************************


;RELEASE VARS ALL                ;release variables and procedures
;RELEASE PROCS ALL
WHILE TRUE                       ;show the menu until either exit
CLEARALL                         ;or error occurs
SHOWPULLDOWN

  "Tickets" : "Cash or lookup voucher ticket press ENTER" : "TicketNode1"
    SUBMENU
      "Cash Ticket" : "Cash Voucher Ticket press ENTER" : "CashTicket1",
      "Extra" : "Calculate value of multiple vouchers press ENTER" : "Calculator
      "Lookup" : "Scan through tickets for verification press ENTER" : "Lookup1"
      "Modify" : "Change a transaction entry and reconcile bank press ENTER" : "
    ENDSUBMENU,

  "Bank Functions" : "Add to bank or cash chips press ENTER" : "BankNode"
     SUBMENU
       "Add" : "Add cash to bank update bank balance" : "AddToBank",
       "Cash Chips" : "Pay cash for chips" : "CashChips"
     ENDSUBMENU,

  "Printouts" : "Transaction and shift reports press ENTER" : "Printouts1"
     SUBMENU
       "Transaction" : "Printout transaction report" : "PrnTrans1",
       "Voucher" : "Voucher summary report" : "ShiftRep1"
     ENDSUBMENU,

  "Manager Functions" : "Closing functions game updates current status more" : "
     SUBMENU
       "Day Shift" : "Close day shift activity" : "DayClose",
       "Swing Shift" : "Close swing shift activity" : "SwingClose",
       "Grave Shift" : "Close graveyard shift activity" : "GraveClose",
       "Final Closeout" : "Close days activity start new day" : "FinalClose",
       "Current Status" : "Lookup current cashier status" : "CurrStatus",
       "Game Functions" : "Change game information add games" : "GameFunction",
       "Add/Remove Cashier" : "Add or remove a cashier" : "CashFunction"
      ENDSUBMENU,


  "Exit" : "Exit this application" : "Exit1"
     SUBMENU
```

```
A:\cashier1.sc                                                          Page 2

        "No" : "Do not exit application" : "Exit/No1",
        "ExitDontSignoff" : "Exit return later" : "ExitNoso1",
        "YesSignoff" : "Exit application and signoff for day" : "Exit/Yes1"
      ENDSUBMENU

ENDMENU UNTIL 17              ;Ctrl-Q to Quit


WHILE True
  GETMENUSELECTION KEYTO KeyVar TO MenuItemSelected
    IF Retval THEN
      QUITLOOP
    ENDIF
    IF KeyVar = 17 THEN
      QUITLOOP
    ENDIF
ENDWHILE


SWITCH
  CASE (MenuItemSelected = "CashTicket1") : PLAY "PROMPTM1"
  CASE (MenuItemSelected = "Calculator1") : PLAY "EXTRA1"
  CASE (MenuItemSelected = "Lookup1") : PLAY "LOOKUP1"
  CASE (MenuItemSelected = "Modify1") : PLAY "CHANGE1"
  CASE (MenuItemSelected = "PrnTrans1") : PLAY "PRNTRAN1"
  CASE (MenuItemSelected = "ShiftRep1") : PLAY "PRNSHFT1"
  CASE (MenuItemSelected = "AddToBank") : PLAY "ADDBANK1"
  CASE (MenuItemSelected = "CashChips") : PLAY "CASHCHP1"
  CASE (MenuItemSelected = "DayClose") : PLAY "DSHIFT1"
  CASE (MenuItemSelected = "SwingClose") : PLAY "SSHIFT1"
  CASE (MenuItemSelected = "GraveClose") : PLAY "GSHIFT1"
  CASE (MenuItemSelected = "FinalClose") : PLAY "FCLOSE1"
  CASE (MenuItemSelected = "ExitNoso1") : EXIT
  CASE (MenuItemSelected = "Exit/Yes1") : PLAY "SIGNOFF1"
ENDSWITCH
ENDWHILE

;*************************************************************************
```

A:\change1.sc Page 1

```
;*********************************************************************
;                          CHANGE1.SC
;
;allows users to view their transaction file
;Copyright 1995 New Gaming Systems Inc.
;*********************************************************************
;                      PROCEDURE ModFileInfo1()
;
;*********************************************************************

PROC ModFileInfo1()

VIEW "CURRENT1"                  ;get the current cashiers transaction
FNAME1=[File-Name]               ;file and allow user to scroll through
CLEARALL                         ;and make entry changes until F-2
EDIT FNAME1
PICKFORM "2"
WAIT TABLE
PROMPT "Page Down through records make changes then press F2"
UNTIL "F2"
DO_IT!
CLEARALL

ENDPROC

;*********************************************************************
;                 PROCEDURE RecFileInfo1()
;
;reconciles to bank after changing information
;
;*********************************************************************
PROC RecFileInfo1()

CLEARALL
VIEW FNAME1
MESSAGE "Reconciling bank please wait..."
SLEEP 2000
BAL1=[Balance]
SCAN
IF [Transaction-Code]="A" THEN
  EDIT FNAME1
  NEWBAL1=BAL1-[Amount-Paid]
  [Balance]=NEWBAL1
  BAL1=NEWBAL1
  DO_IT!
ENDIF
IF [Transaction-Code]="B" THEN
  EDIT FNAME1
  NEWBAL1=BAL1+[Amount-Added]
  [Balance]=NEWBAL1
  BAL1=NEWBAL1
  DO_IT!
```

A:\change1.sc Page 2

```
ENDIF
IF [Transaction-Code]="C" THEN
  EDIT FNAME1
  [Balance]=BAL1
  DO IT!
ENDIF
ENDSCAN
MESSAGE "Bank reconciled new balance = ",BAL1
ENDPROC

;*********************************************************************
;                          MAIN
;*********************************************************************

ModFileInfo1()
RecFileInfo1()
RELEASE VARS FNAME1,BAL1,NEWBAL1
RELEASE PROCS ModFileInfo1,RecFileInfo1
```

A:\dltran1.sc Page 1

```
;*********************************************************************
;DLTRAN1.SC
;Copyright 1995 New Gaming Systems Inc.
;*********************************************************************


MENU
{Report} {Change}
TYPEIN FNAME1
ENTER
{1} {SHODAKAI CASINO TRANSACTION REPORT}
Down Down Down Down Right Right Right Right Right Right Right
Right Right Right Right Right Right Right Right Right Right
Right Right Right Right Right Right Right Right Right Right
Right Right Right Right Right Right Right Right Right
TYPEIN CASHNAM1
TYPEIN "            "
Do_It!
CLEARALL
CLEAR
```

A:\dlvouch1.sc Page 1

```
;*************************************************************************
;DLVOUCH1.SC
;Copyright 1995 New Gaming Systems Inc.
;*************************************************************************

Menu {Report} {Change} {Shift1} {1} {SHODAKAI CASINO INDIVIDUAL VOUCHER PAYOU}
Down Down Down Down Right Right Right Right Right Right Right
Right Right Right Right Right Right Right Right Right Right
Right Right Right Right Right Right Right Right Right Right
Right Right Right Right Right Right  "Alicia Ruiz   " Do_It!
Menu {Scripts} {End-Record}
```

A:\dshift1.sc Page 1

```
;*********************************************************************
;DSHIFT1.SC
;Copyright 1995 New Gaming Systems Inc.
;*********************************************************************

PROC SeeIfLead()

ISLEAD=0

VIEW "CURRENT1"

FNAME=[File-Name]
CLEARALL
VIEW "CASHIER"
SCAN
  IF [File Name]=FNAME THEN
    IF [Lead Cashier]="Y" THEN
      ISLEAD=1
    ENDIF
  ENDIF
ENDSCAN
CLEARALL
ENDPROC
;*********************************************************************
;
PROC GetTheInf(FNAMEX)
  VIEW "CASHIER"
  SCAN
  IF [File Name]=FNAMEX THEN
    CASHNUM=[Cashier Number]
    CASHNAM=[Cashier Name]
    LEAD=[Lead Cashier]
  ENDIF
  ENDSCAN
  CLEARALL
  TOTFILL=0
  TOTCHIP=0
  TOTPAY=0
  VIEW FNAMEX
  SCAN
  IF ([Transaction-Code]="S") OR ([Transaction-Code]="B") THEN
    TOTFILL=TOTFILL+[Amount-Added]
  ENDIF
  IF ([Transaction-Code]="C") THEN
    TOTCHIP=TOTCHIP+[Amount-Added]
  ENDIF
  IF ([Transaction-Code]="A") THEN
    TOTPAY=TOTPAY+[Amount-Paid]
  ENDIF
  ENDSCAN
  VIEW "CASHREP"
  IF ISEMPTY("CASHREP") THEN
```

A:\dshift1.sc Page 2

```
    EDIT "CASHREP"
  ELSE
    EDIT "CASHREP"
    END DOWN
  ENDIF
  [Cashier Number]=CASHNUM
  [Cashier Name]=CASHNAM
  [Lead Cashier]=LEAD
  [Fills]=TOTFILL
  [Chips]=TOTCHIP
  [Payouts]=TOTPAY
  [Balance]=TOTFILL-TOTPAY
  DO_IT!

ENDPROC
;*************************************************************************
SeeIfLead()

IF ISLEAD=0 THEN
  MESSAGE "Only lead cashiers can use this function...."
ENDIF

IF ISLEAD=1 THEN
  MESSAGE "Accumulating shift totals..."
  BIGTF=0
  BIGTP=0
  BIGTC=0
  EMPTY "CASHREP"
  GetTheInf(FNAME)
  BIGTF=BIGTF+TOTFILL
  BIGTP=BIGTP+TOTPAY
  BIGTC=BIGTC+TOTCHIP
  VIEW "CURRENT2"
  FNAME2=[File-Name]
  CLEARALL
  GetTheInf(FNAME2)
  BIGTF=BIGTF+TOTFILL
  BIGTP=BIGTP+TOTPAY
  BIGTC=BIGTC+TOTCHIP
  CLEARALL
  VIEW "CURRENT3"
  FNAME3=[File-Name]
  GetTheInf(FNAME3)
  BIGTF=BIGTF+TOTFILL
  BIGTP=BIGTP+TOTPAY
  BIGTC=BIGTC+TOTCHIP
  ADD "CASHREP" "DAYACT"

  EDIT "CASHREP"
  END DOWN DOWN
  [Cashier Name]="Totals"
  [Fills]=BIGTF
```

```
A:\dshift1.sc                                                    Page 3

  [Chips]=BIGTC
  [Payouts]=BIGTP
  [Balance]=BIGTF-BIGTP
  DO_IT!
  MESSAGE "Printing cashier shift report..."
  SLEEP 1500
Menu {Report} {Output} {Cashrep} {1} {Printer}
Menu {Scripts} {End-Record}
  CLEARALL

  MESSAGE "Day shift lead cashier should signoff now let the swing shift begin..
ENDIF
RELEASE VARS FNAME,ISLEAD,TOTFILL,TOTPAY,TOTCHIP,FNAME2,FNAME3,FNAMEX,LEAD,CASHN
RELEASE PROCS SeeIfLead,GetTheInf
```

A:\extra1.sc Page 1

```
;*********************************************************************
;EXTRA1.SC
;Copyright 1995 New Gaming Systems Inc.
;*********************************************************************


EMPTY "MULTK1"
EDIT "MULTK1"
WAIT TABLE
PROMPT "Enter machine numbers and ticket values then press F2"
UNTIL "F2"
DO IT!
CLEARALL
IF NOT ISEMPTY("MULTK1") THEN

Z1=NRECORDS("COYOTE")
NEXT1=NRECORDS("MULTK1")
ARRAY MACNUM1[NEXT1]
ARRAY TIKVAL1[NEXT1]
TOTVAL1=0
EXT1=1
VIEW "MULTK1"
SCAN
  CK1=INT([MACHINE-#])
  IF (CK1<1) OR (CK1>Z1) THEN
    CK1=Z1
  ENDIF
  MACNUM1[EXT1]=CK1
  TIKVAL1[EXT1]=[TICKET-VALUE]
  TOTVAL1=TOTVAL1+TIKVAL1[EXT1]
  EXT1=EXT1+1
ENDSCAN

EDIT "MULTK1"
END DOWN DOWN
[TICKET-VALUE]=TOTVAL1
DO IT!
CLEARALL

VIEW "MULTK1"
END
MESSAGE "$",TOTVAL1," is the total value of tickets entered."
SLEEP 2000
WAIT TABLE
PROMPT "Press F2 to continue"
UNTIL "F2"
;*********************************************************************

@10,15
??"Record vouchers Y/N ? "
ACCEPT "A1" TO RECANS1
```

A:\extra1.sc Page 2

```
IF (RECANS1="Y") OR (RECANS1="y") THEN

  VIEW "CURRENT1"
  FNAME1=[File-Name]
  CLEARALL
  VIEW FNAME1
  END
  BAL1=[Balance]
  EDIT FNAME1
  DOWN
  FOR K1 FROM 1 TO NEXT1
    [Date]=TODAY()
    [Time]=TIME()
    [Transaction-Code]="A"
    [Machine-#]=MACNUM1[K1]
    [Amount-Paid]=TIKVAL1[K1]
    [Amount-Added]=0
    [Balance]=BAL1-TIKVAL1[K1]
    BAL1=[Balance]
    DOWN
  ENDFOR
  DO_IT!
;*******************************************************
  @10,15
  ??"Print Voucher Transactions Y/N "
    ACCEPT "A1" TO PRNANS1
    IF PRNANS1="Y" OR PRNANS1="y" THEN
      PLAY "OUTXTRA1"
      MESSAGE "Tape Printed................"
      SLEEP 1000
    ENDIF

;*******************************************************
  CLEARALL
  MESSAGE "Multiple vouchers recorded new bank balance is $ ",BAL1

  ELSE
    MESSAGE "If above values are correct use {Tickets}->{Cash Ticket} function t
    SLEEP 1000
ENDIF
    RELEASE VARS NEXT1,MACNUM1,TIKVAL1,EXT1,TOTVAL1,RECANS1,FNAME1,K1,Z1,CK1
ENDIF
```

A:\fclose1.sc Page 1

```
;*********************************************************************
;                        FCLOSE1.SC
;
;allows graveyard lead cashier to produce final closing
;Copyright 1995 New Gaming Systems Inc.
;*********************************************************************
;*********************************************************************
;                       PROCEDURE CopToDisk()
;
;**********************************************************************
PROC CopToDisk()
  I=1
  VIEW "CASHIER"
  SCAN
    FNAME=[File Name]
    ALTFNAME=[Alternate]
    DELETE ALTFNAME
    COPY FNAME ALTFNAME
    IF NOT ISEMPTY(FNAME) THEN
      COPY FNAME "A:"+FNAME
      MESSAGE "Copying ",FNAME," to A:",FNAME
    ENDIF
    FILEOF[I]=FNAME
    I=I+1
  ENDSCAN
  CLEARALL
  CLEAR

ENDPROC
;**********************************************************************
PROC PrintLtran()


VIEW "CURRENT1"
FNAME1=[File-Name]
PLAY "FDLTRAN"
CLEARALL
CLEAR

IF PRINTERSTATUS() THEN
  MESSAGE "Printing grave shift managers transaction report....."
  SLEEP 1000
  Menu
  {Report} {Output}
  TYPEIN FNAME1
  ENTER
  {1} {Printer} Esc {Scripts} {End-Record}
  MESSAGE "Print request complete..."
  SLEEP 2000
  GOODPRNT=1
ELSE MESSAGE "Printer not ready check power on-line and paper then try again..."
     SLEEP 2000
```

```
ENDIF

ENDPROC

;*************************************************************************
;                        Procedure PrintLvouch()
;*************************************************************************
PROC PrintLvouch()

VIEW "CURRENT1"                        ;get cashiers transaction file
FNAME1=[File-Name]                     ;and initialize arrays


Menu {Report} {Change} {Shift1} {1} {CHICKEN RANCH INDIVIDUAL VOUCHER PAYOU}
Down Down Down Down Right Right Right Right Right Right Right
Right Right Right Right Right Right Right Right Right Right
Right Right Right Right Right Right Right Right Right Right
Right Right Right Right Right Right
TYPEIN IMPCNAME
TYPEIN "      "
Do_It!



Z=NRECORDS("COYOTE")

ARRAY NUMTICK1[Z]                      ;this array tracks #-tickets/machine
ARRAY TOTPAY1[Z]                       ;this array tracks total payouts/machine
MESSAGE "Initializing Arrays..."
SLEEP 2000
FOR K1 FROM 1 TO Z                     ;initializing arrays
  NUMTICK1[K1]=0
  TOTPAY1[K1]=0
ENDFOR
MESSAGE "Processing totals..."
SLEEP 2000
VIEW FNAME1
SCAN
  IF [Transaction-Code]="A" THEN                ;check transaction file for
    I1=INT([Machine-#])
    IF (I1<1) OR (I1>Z) THEN
      I1=Z
    ENDIF                                       ;voucher tickets cashed
    NUMTICK1[I1]=NUMTICK1[I1]+1                 ;and run them
    TOTPAY1[I1]=TOTPAY1[I1]+[Amount-Paid]
  ENDIF
ENDSCAN
BIGTICK1=0
```

```
A:\fclose1.sc                                                          Page 3

BIGPAY1=0

EMPTY "SHIFT1"                              ;fill out report table
EDIT "SHIFT1"

FOR J1 FROM 1 TO Z
  [Comments]="Totals"
  [Machine-#]=J1
  [Number-Tickets]=NUMTICK1[J1]
  [Total-Payouts]=TOTPAY1[J1]
  BIGTICK1=NUMTICK1[J1]+BIGTICK1
  BIGPAY1=TOTPAY1[J1]+BIGPAY1
  DOWN
ENDFOR
DOWN DOWN
[Comments]="Grand Totals"
[Number-Tickets]=BIGTICK1
[Total-Payouts]=BIGPAY1
DO_IT!
IF PRINTERSTATUS() THEN                       ;if the printer is ready send report
  MESSAGE "Printing shift leaders voucher report..."
  {Report} {Output} {shift1} {1} {Printer} {Scripts} {End-Record}
  MESSAGE "Printing Complete..."
  ELSE MESSAGE "Printer not ready check to see if online with paper then rerun"
ENDIF

CLEARALL


ENDPROC

;*********************************************************************
;                      Procedure AddAllTicks
;*********************************************************************
PROC AddAllTicks()

FOR K FROM 1 TO W
   ADD FILEOF[K] "BIGTICKS"
ENDFOR

ENDPROC

;*********************************************************************
;                          Procedure PrintAllCash()
;*********************************************************************
PROC PrintAllCash()
TOTF=0
TOTC=0
TOTP=0
TOTB=0
```

```
A:\fclose1.sc                                                          Page 4

VIEW "DAYACT"
SCAN
TOTF=TOTF+[Fills]
TOTC=TOTC+[Chips]
TOTP=TOTP+[Payouts]
TOTB=TOTB+[Balance]
ENDSCAN
EDIT "DAYACT"
END DOWN DOWN
[Cashier Name]="Days Totals"
[Fills]=TOTF
[Chips]=TOTC
[Payouts]=TOTP
[Balance]=TOTB
DO IT!
CLEARALL
CLEAR

Menu {Report} {Output} {Dayact} {1} {Printer}
Menu {Scripts} {End-Record}
COPY "DAYACT" "A:DAYACT"
MESSAGE "Copying DAYACT to A:DAYACT..."
SLEEP 1000
ENDPROC
;*************************************************************************

;*************************************************************************
;                          Procedure PrintFinalVouch()
;*************************************************************************
PROC PrintFinalVouch()


Z=NRECORDS("COYOTE")

ARRAY NUMTICK[Z]                    ;this array tracks #-tickets/machine
ARRAY TOTPAY[Z]                     ;this array tracks total payouts/machine
MESSAGE "Initializing Arrays..."
SLEEP 2000
FOR K1 FROM 1 TO Z                   ;initializing arrays
  NUMTICK[K1]=0
  TOTPAY[K1]=0
ENDFOR
MESSAGE "Processing daily totals..."
SLEEP 2000
VIEW "BIGTICKS"
SCAN
  IF [Transaction-Code]="A" THEN             ;check transaction file for
    I1=INT([Machine-#])
    IF (I1<1) OR (I1>Z) THEN
       I1=Z
    ENDIF                                    ;voucher tickets cashed
    NUMTICK[I1]=NUMTICK[I1]+1               ;and run them
```

```
    TOTPAY[I1]=TOTPAY[I1]+[Amount-Paid]
  ENDIF
ENDSCAN
BIGTICK=0
BIGPAY=0

EMPTY "FSHIFT"                          ;fill out report table
EDIT "FSHIFT"

FOR J1 FROM 1 TO Z
  [Comments]="Totals"
  [Machine-#]=J1
  [Number-Tickets]=NUMTICK[J1]
  [Total-Payouts]=TOTPAY[J1]
  BIGTICK=NUMTICK[J1]+BIGTICK
  BIGPAY=TOTPAY[J1]+BIGPAY
  DOWN
ENDFOR
DOWN DOWN
[Comments]="Grand Totals"
[Number-Tickets]=BIGTICK
[Total-Payouts]=BIGPAY
DO_IT!
IF PRINTERSTATUS() THEN                  ;if the printer is ready send report
  MESSAGE "Printing daily voucher report..."
  {Report} {Output} {fshift} {1} {Printer} {Scripts} {End-Record}
  MESSAGE "Printing Complete..."
  ELSE MESSAGE "Printer not ready check to see if online with paper then rerun"
ENDIF

CLEARALL
COPY "FSHIFT" "A:FSHIFT"
MESSAGE "Copying FSHIFT to A:FSHIFT..."
SLEEP 1000
ENDPROC

;*************************************************************************
PROC EmptyTicks()

FOR K FROM 1 TO W
  EMPTY FILEOF[K]
ENDFOR
EMPTY "DAYACT"

ENDPROC

;*************************************************************************


VIEW "CURRENT1"
IMPFNAME=[File-Name]
CLEARALL
```

A:\fclose1.sc Page 6

```
VIEW "CASHIER"
SCAN
IF [File Name]=IMPFNAME THEN
 IMPCNAME=[Cashier Name]
 IMPPW=[Password]
ENDIF
 ENDSCAN
 CLEARALL
 CLEAR
 MESSAGE IMPCNAME," CAUTION YOU WILL BE SIGNING OFF WHEN COMPLETE..."
 SLEEP 5000
 CLEAR @10,15
 ??"Continue Y/N ? "
 ACCEPT "A1" TO CONTANS
 CLEAR

IF CONTANS="Y" OR CONTANS="y" THEN
 CLEAR @10,15
 ??IMPCNAME," Please enter your password "
 CANVAS OFF
 ACCEPT "A6" TO THEPW
 CLEAR
 CANVAS ON
 IF THEPW=IMPPW THEN
   GOODPRNT=0                    ;^^^^^^^^MAKE THIS ZERO
   PrintLtran()
   IF GOODPRNT=1 THEN
     PrintLvouch()
     W=NRECORDS("CASHIER")
     ARRAY FILEOF[W]
     MESSAGE "Please insure daily floppy disk is inserted into drive a:..."
     SLEEP 3000
     GOODDRIV=0
     CLEAR @10,15
     ??"Is disk inserted into a: drive Y/N ? "
     ACCEPT "A1" TO DRIVANS
     IF DRIVANS="Y" OR DRIVANS="y" THEN
       IF DRIVESTATUS("A") THEN
         GOODDRIV=1
         EMPTY "BIGTICKS"
         CopToDisk()
         AddAllTicks()
         PrintFinalVouch()
         PrintAllCash()
         EmptyTicks()
         EDIT "ONOFLOG1"
         END
         [Date-Off]=TODAY()
         [Time-Off]=TIME()
         DO_IT!
         MESSAGE IMPCNAME," Signing off system..."
         EXIT
```

A:\fclose1.sc Page 7

```
      ENDIF
    ELSE MESSAGE "Your floppy drive does not seem to be ready please insert dis
    ENDIF
  ENDIF
 ELSE MESSAGE "Incorrect password entered..."
 ENDIF
ENDIF
```

A:\gshift1.sc Page 1

```
;*********************************************************************
;GSHIFT1.SC
;Copyright 1995 New Gaming Systems Inc.
;*********************************************************************

PROC SeeIfLead()

ISLEAD=0

VIEW "CURRENT1"

FNAME=[File-Name]
CLEARALL
VIEW "CASHIER"
SCAN
  IF [File Name]=FNAME THEN
    IF [Lead Cashier]="Y" THEN
      ISLEAD=1
    ENDIF
  ENDIF
ENDSCAN
CLEARALL
ENDPROC
;*********************************************************************
;
PROC GetTheInf(FNAMEX)
  VIEW "CASHIER"
  SCAN
  IF [File Name]=FNAMEX THEN
    CASHNUM=[Cashier Number]
    CASHNAM=[Cashier Name]
    LEAD=[Lead Cashier]
  ENDIF
  ENDSCAN
  CLEARALL
  TOTFILL=0
  TOTCHIP=0
  TOTPAY=0
  VIEW FNAMEX
  SCAN
  IF ([Transaction-Code]="S") OR ([Transaction-Code]="B") THEN
    TOTFILL=TOTFILL+[Amount-Added]
  ENDIF
  IF ([Transaction-Code]="C") THEN
    TOTCHIP=TOTCHIP+[Amount-Added]
  ENDIF
  IF ([Transaction-Code]="A") THEN
    TOTPAY=TOTPAY+[Amount-Paid]
  ENDIF
  ENDSCAN
  VIEW "CASHREP"
  IF ISEMPTY("CASHREP") THEN
```

A:\gshift1.sc Page 2

```
    EDIT "CASHREP"
  ELSE
    EDIT "CASHREP"
    END DOWN
  ENDIF
  [Cashier Number]=CASHNUM
  [Cashier Name]=CASHNAM
  [Lead Cashier]=LEAD
  [Fills]=TOTFILL
  [Chips]=TOTCHIP
  [Payouts]=TOTPAY
  [Balance]=TOTFILL-TOTPAY
  DO_IT!

ENDPROC
;*************************************************************************
SeeIfLead()

IF ISLEAD=0 THEN
  MESSAGE "Only lead cashiers can use this function...."
ENDIF

IF ISLEAD=1 THEN
  MESSAGE "Accumulating shift totals..."
  BIGTF=0
  BIGTP=0
  BIGTC=0
  EMPTY "CASHREP"
  GetTheInf(FNAME)
  BIGTF=BIGTF+TOTFILL
  BIGTP=BIGTP+TOTPAY
  BIGTC=BIGTC+TOTCHIP
  VIEW "CURRENT2"
  FNAME2=[File-Name]
  CLEARALL
  GetTheInf(FNAME2)
  BIGTF=BIGTF+TOTFILL
  BIGTP=BIGTP+TOTPAY
  BIGTC=BIGTC+TOTCHIP
  CLEARALL
  VIEW "CURRENT3"
  FNAME3=[File-Name]
  GetTheInf(FNAME3)
  BIGTF=BIGTF+TOTFILL
  BIGTP=BIGTP+TOTPAY
  BIGTC=BIGTC+TOTCHIP
  ADD "CASHREP" "DAYACT"

  EDIT "CASHREP"
  END DOWN DOWN
  [Cashier Name]="Totals"
  [Fills]=BIGTF
```

A:\gshift1.sc Page 3

```
  [Chips]=BIGTC
  [Payouts]=BIGTP
  [Balance]=BIGTF-BIGTP
  DO IT!
  MESSAGE "Printing cashier shift report..."
  SLEEP 1500
Menu {Report} {Output} {Cashrep} {3} {Printer}
Menu {Scripts} {End-Record}
  CLEARALL

  MESSAGE "Lead cashier should close days activity then signoff and let the new
ENDIF
RELEASE VARS FNAME,ISLEAD,TOTFILL,TOTPAY,TOTCHIP,FNAME2,FNAME3,FNAMEX,LEAD,CASHN
RELEASE PROCS SeeIfLead,GetTheInf
```

A:\lookup1.sc Page 1

```
;*********************************************************************
;                          LOOKUP1.SC
;
;allows users to view their transaction file
;Copyright 1995 New Gaming Systems Inc.
;*********************************************************************
;                      PROCEDURE SeeFileInfo()
;
;*********************************************************************

PROC SeeFileInfo()

VIEW "CURRENT1"                 ;get the current cashiers transaction
FNAME1={File-Name}              ;file and allow user to scroll through
CLEARALL                        ;entries until user presses F-2
VIEW FNAME1
PICKFORM "1"
WAIT TABLE
PROMPT "Use Page Down/Up keys to scroll through transactions then press F2"
UNTIL "F2"
DO IT!
CLEARALL

ENDPROC
;*********************************************************************
;                           MAIN
;*********************************************************************

SeeFileInfo()
RELEASE VARS FNAME1
RELEASE PROCS SeeFileInfo
```

A:\outshift.sc Page 1

```
;*********************************************************************
;OUTSHIFT.SC
;Copyright 1995 New Gaming Systems Inc.
;*********************************************************************

Menu {Report} {Output} {Cashrep} {1} {Printer}
Menu {Scripts} {End-Record}
```

A:\prnshft1.sc Page 1

```
;*********************************************************************
;                          PRNSHFT1.SC
;
;this script uses the cashiers transaction file to assimilate a voucher
;payout report and send it to the printer
;Copyright 1995 New Gaming Systems Inc.
;*********************************************************************

VIEW "CURRENT1"                     ;get cashiers transaction file
FNAME1=[File-Name]                  ;and initialize arrays
CLEARALL

VIEW "CASHIER1"
SCAN
IF FNAME1=[File Name] THEN
   CASHNAM1=[Cashier Name]
ENDIF
ENDSCAN
CLEARALL
CLEAR


Menu {Report} {Change} {Shift1} {1} {CHICKEN RANCH INDIVIDUAL VOUCHER PAYOUT}
Down Down Down Down Right Right Right Right Right Right Right
Right Right Right Right Right Right Right Right Right Right
Right Right Right Right Right Right Right Right Right Right
Right Right Right Right Right Right
TYPEIN CASHNAM1
TYPEIN "         "
Do_It!


Z=NRECORDS("COYOTE")

ARRAY NUMTICK1[Z]                   ;this array tracks #-tickets/machine
ARRAY TOTPAY1[Z]                    ;this array tracks total payouts/machine
MESSAGE "Initializing Arrays..."
SLEEP 2000
FOR K1 FROM 1 TO Z                  ;initializing arrays
  NUMTICK1[K1]=0
  TOTPAY1[K1]=0
ENDFOR
MESSAGE "Processing totals..."
SLEEP 2000
VIEW FNAME1
SCAN
  IF [Transaction-Code]="A" THEN             ;check transaction file for
    I1=INT([Machine-#])
    IF (I1<1) OR (I1>Z) THEN
      I1=Z
    ENDIF                            ;voucher tickets cashed
    NUMTICK1[I1]=NUMTICK1[I1]+1              ;and run them
```

A:\prnshft1.sc Page 2

```
    TOTPAY1[I1]=TOTPAY1[I1]+[Amount-Paid]
  ENDIF
ENDSCAN
BIGTICK1=0
BIGPAY1=0

EMPTY "SHIFT1"                          ;fill out report table
EDIT "SHIFT1"

FOR J1 FROM 1 TO Z
  [Comments]="Totals"
  [Machine-#]=J1
  [Number-Tickets]=NUMTICK1[J1]
  [Total-Payouts]=TOTPAY1[J1]
  BIGTICK1=NUMTICK1[J1]+BIGTICK1
  BIGPAY1=TOTPAY1[J1]+BIGPAY1
  DOWN
ENDFOR
DOWN DOWN
[Comments]="Grand Totals"
[Number-Tickets]=BIGTICK1
[Total-Payouts]=BIGPAY1
DO_IT!
IF PRINTERSTATUS() THEN                  ;if the printer is ready send report
  MESSAGE "Printing Report..."
  {Report} {Output} {shift1} {1} {Printer} {Scripts} {End-Record}
  MESSAGE "Printing Complete..."
  ELSE MESSAGE "Printer not ready check to see if online with paper then rerun"
ENDIF

CLEARALL
RELEASE VARS K1,FNAME1,NUMTICK1,TOTPAY1,I1,BIGTICK1,BIGPAY1,J1,CASHNAM1
```

A:\prntran1.sc Page 1

```
;*********************************************************************
;PRNTRAN1.SC
;Copyright 1995 New Gaming Systems Inc.
;*********************************************************************


VIEW "CURRENT1"
FNAME1=[File-Name]
VIEW "CASHIER1"
SCAN
IF FNAME1=[File Name] THEN
  CASHNAM1=[Cashier Name]
ENDIF
ENDSCAN
CLEARALL
CLEAR
PLAY "DLTRAN1"

IF PRINTERSTATUS() THEN
  MESSAGE "Printing Report....."
  SLEEP 1000
  Menu
  {Report} {Output}
  TYPEIN FNAME1
  ENTER
  {1} {Printer} Esc {Scripts} {End-Record}
  MESSAGE "Print request complete..."
ELSE MESSAGE "Printer not ready check power on-line and paper then try again..."
ENDIF
RELEASE VARS FNAME1,CASHNAM1
```

A:\promptm1.sc Page 1

```
;*************************************************************************
;                        PROMPTM1.SC
;
;provides an input form for users input of voucher ticket payout
;information.
;Copyright 1995 New Gaming Systems Inc.
;*************************************************************************
;                        PROCEDURE GetVouchInfo()
;
;this procedure provides an interface for users to enter ticket voucher
;information as the tickets are cashed
;
;*************************************************************************

PROC GetVouchInfo()


EMPTY "PROMPT1"                 ;empty input table
EDIT "PROMPT1"                  ;edit it write date and time to table
PICKFORM "1"                    ;
[Date]=TODAY()
[Time]=TIME()
MOVETO [Machine-#]              ;moveto machine number field of form
WAIT RECORD
PROMPT "Enter Machine-#, Validation-#, and Ticket Value then press F2."
UNTIL "F2"
DO IT!                          ;user fills out information then presses
CLEARIMAGE                      ;F2 then save file

VIEW "PROMPT1"                  ;now get the variables
MACNUM1=[Machine-#]              ;assign all responses to "Y"
VERIFNUM1=[Validation-#]
NUMCRED1=[Payout Amount]
CLEARALL
ANS11="Y"
ANS12="Y"
ANS13="Y"

ENDPROC
;*************************************************************************
;                         PROCEDURE VerifyData()
;
;this procedure checks information for obviously bogus data
;
;*************************************************************************


PROC VerifyData()


TICKETVAL1=NUMCRED1
CLEARALL
```

A:\promptm1.sc Page 2

```
VIEW "CURRENT1"                         ;find current cashiers transaction
DATFILE1=[File-Name]                    ;file and balance
VIEW DATFILE1
END
BALANCE1=[Balance]
IF (MACNUM1 > 0) AND (MACNUM1 < NRECORDS("COYOTE") AND (NUMCRED1>0)) THEN
  EDIT DATFILE1
  END DOWN                              ;if the machine number and the
  [Date]=TODAY()                        ;payout amount appear valid
  [Time]=TIME()                         ;then record transaction and
  [Transaction-Code]="A"
  [Machine-#]=INT(MACNUM1)              ;calculate new balance
  [Verification-#]=VERIFNUM1            ;otherwise transaction is not recorded
  [Amount-Paid]=TICKETVAL1              ;and user is told
  [Amount-Added]=0.00                   ;
  [Balance]=BALANCE1-TICKETVAL1
  DO IT!
  G=MEMLEFT()
  MESSAGE "Viewing last transaction bank balance is $ ",BALANCE1-TICKETVAL1,"  "
;SLEEP 2000
  CLEARALL
  CLEARIMAGE
ELSE MESSAGE "Invalid machine number or ticket value above transaction not recor
;  SLEEP 2000
  CLEARALL
ENDIF

CLEARALL
ENDPROC

;*********************************************************************
;                          MAIN
;
;*********************************************************************

GetVouchInfo()
VerifyData()
RELEASE VARS MACNUM1,VERIFNUM1,NUMCRED1,ANS11,ANS12,ANS13,TICKETVAL1,DATFILE1,BA
RELEASE PROCS GetVouchInfo,VerifyData

;*********************************************************************
;                        END PROGRAM
;*********************************************************************
```

A:\signoff1.sc Page 1

```
;*************************************************************************
;                              SIGNOFF.SC
;
;allows user to signoff and end shift prints out final transaction and
;shift reports.
;Copyright 1995 New Gaming Systems Inc.
;*************************************************************************
;                         PROCEDURE ASKEM1()
;
;clears screen for prompts and user input
;*************************************************************************


PROC ASKEM1()
CLEAR @10,15
ENDPROC

;*************************************************************************
;                         PROCEDURE ASKCLS1
;
;makes first confirmation that cashier is signing off for day
;
;*************************************************************************


PROC ASKCLS1()
  ASKEM1()                                                ;gets an answer
  ??CASHNAM1," are you signing off for the day? Y/N "
  ACCEPT "A1" TO CLSANS1
ENDPROC

;*************************************************************************
;MESSAGE "MAKE SURE PRINTER IS READY"
;SLEEP 5000


;*************************************************************************
;                       PROCEDURE CashierInfo1()
;
;this procedure stores cashiers name, number, password, and transaction file
;as variables
;*************************************************************************
PROC CashierInfo1()

  VIEW "CURRENT1"                          ;get transaction file
  FNAME1=[File-Name]                       ;FNAME1 is the transaction file
  CLEARALL

  VIEW "ONOFLOG1"
  END
```

```
A:\signoff1.sc                                                          Page 2

  CASHNUM1=[Cashier-#]                    ;CASHNUM1 is the cashier number
  CASHNAM1=[Cashier]                      ;CASHNAM1 is the cashier name
  CLEARALL

  VIEW "CASHIER1"                         ;
  SCAN
  IF (CASHNUM1=[Cashier Number]) THEN
        PW1=[Password]                   ;PW1 is cashiers password
  ENDIF
  ENDSCAN
  CLEARALL
  CLEAR
ENDPROC
;*************************************************************************
;                        PROCEDURE SendTransReport1()
;
;sends final transaction report upon cashier signoff
;
;*************************************************************************
PROC SendTransReport1()

VIEW "CURRENT1"
FNAME1=[File-Name]
PLAY "DLTRAN1"

IF PRINTERSTATUS() THEN
  MESSAGE "Printing Report....."
  SLEEP 1000
  Menu
  {Report} {Output}
  TYPEIN FNAME1
  ENTER
  {1} {Printer} Esc {Scripts} {End-Record}
  MESSAGE "Print request complete..."
ELSE MESSAGE "Printer not ready check power on-line and paper then try again..."
     GOODPRN1=1
ENDIF


ENDPROC
;*************************************************************************
;*************************************************************************
;                        PROCEDURE SendFinalVouch1()
;
;sends final ticket voucher report to printer
;*************************************************************************

PROC SendFinalVouch1()

VIEW "CURRENT1"                      ;get cashiers transaction file
FNAME1=[File-Name]                   ;and initialize arrays
```

A:\signoff1.sc Page 3

```
Menu {Report} {Change} {Shift1} {1} {SHODAKAI CASINO INDIVIDUAL VOUCHER PAYOU}
Down Down Down Down Right Right Right Right Right Right
Right Right Right Right Right Right Right Right Right Right
Right Right Right Right Right Right Right Right Right Right
Right Right Right Right Right Right
TYPEIN CASHNAM1
TYPEIN "          "
Do_It!
Menu {Scripts} {End-Record}
```

```
Z=NRECORDS("COYOTE")

ARRAY NUMTICK1[Z]                    ;this array tracks #-tickets/machine
ARRAY TOTPAY1[Z]                     ;this array tracks total payouts/machine
MESSAGE "Initializing Arrays..."
SLEEP 2000
FOR K1 FROM 1 TO Z                   ;initializing arrays
  NUMTICK1[K1]=0
  TOTPAY1[K1]=0
ENDFOR
MESSAGE "Processing totals..."
SLEEP 2000
VIEW FNAME1
SCAN
  IF [Transaction-Code]="A" THEN             ;check transaction file for
    I1=INT([Machine-#])
    IF (I1<1) OR (I1>Z) THEN
      I1=Z
    ENDIF                              ;voucher tickets cashed
    NUMTICK1[I1]=NUMTICK1[I1]+1                ;and run them
    TOTPAY1[I1]=TOTPAY1[I1]+[Amount-Paid]
  ENDIF
ENDSCAN
BIGTICK1=0
BIGPAY1=0

EMPTY "SHIFT1"                             ;fill out report table
EDIT "SHIFT1"

FOR J1 FROM 1 TO Z
  [Comments]="Totals"
  [Machine-#]=J1
  [Number-Tickets]=NUMTICK1[J1]
  [Total-Payouts]=TOTPAY1[J1]
  BIGTICK1=NUMTICK1[J1]+BIGTICK1
  BIGPAY1=TOTPAY1[J1]+BIGPAY1
```

A:\signoff1.sc Page 4

```
  DOWN
ENDFOR
DOWN DOWN
[Comments]="Grand Totals"
[Number-Tickets]=BIGTICK1
[Total-Payouts]=BIGPAY1
DO IT!
IF PRINTERSTATUS() THEN                    ;if the printer is ready send report
  MESSAGE "Printing Report..."
  {Report} {Output} {shift1} {1} {Printer} {Scripts} {End-Record}
  MESSAGE "Printing Complete..."
  ELSE MESSAGE "Printer not ready check to see if online with paper then rerun"
  GOODPRN1=1
ENDIF

ENDPROC
;*************************************************************************
;                                MAIN
;
;*************************************************************************

CashierInfo1()
CLSANS1="N"
ASKCLS1()

CLEAR
IF (CLSANS1="Y") OR (CLSANS1="y") THEN
  ASKEM1()
  ??"Are you sure you want to signoff for the day? Y/N "
  ACCEPT "A1" TO CLSANS1
  CLEAR                          ;if user answered "y" or "Y" then
ENDIF                            ;reconfirm
                                 ;
IF (CLSANS1="Y") OR (CLSANS1="y") THEN

;  ASKEM1()                          ;now ask for cashier number
;  ??"Enter Cashier Number "         ;lookup cashier number and password in
;  ACCEPT "N" TO CASHNUM1            ;CASHIER table
;  CLEAR

  ASKEM1()
  ??CASHNAM1, " Please Enter Password "
  CANVAS OFF
  ACCEPT "A6" TO CHKPW1
  CLEAR
    IF CHKPW1=PW1 THEN
      GOODPRN1=0
      SendTransReport1()
      SendFinalVouch1()
      IF GOODPRN1=0 THEN
        EDIT "CNOFLOG1"
        END
```

A:\signoff1.sc Page 5

```
        [Date-Off]=TODAY()
        [Time-Off]=TIME()
        DO IT!
        CLEARALL
        CLEAR
        CANVAS ON
        ;****insert printout procedures here****;
        MESSAGE CASHNAM1, " now signing off system............"
        SLEEP 5000
        EXIT
      ELSE CANVAS ON
        MESSAGE "Please check printer status then attempt signoff again..."
      ENDIF
    ELSE CANVAS ON
       MESSAGE "Invalid password entered................"
         SLEEP 2000
    ENDIF
ENDIF
RELEASE VARS CASHNAM1,CLSANS1,FNAME1,CASHNUM1,PW1,GOODPRN1,NUMTICK1,TOTPAY1,K1,I

RELEASE PROCS ASKEM1,ASKCLS1,CashierInfo1,SendTransReport1,SendFinalVouch1
```

A:\signon1.sc Page 1

```
;*********************************************************************
;SIGNON1.SC
;Copyright 1995 New Gaming Systems Inc.
;*********************************************************************

RELEASE VARS ALL

;*********************************************************************
;                 PRCEDURE ASKEM()
;
;this procedure clears the screen for an input prompt
;*********************************************************************

PROC ASKEM1()
CLEAR @10,15
ENDPROC

;*********************************************************************
;                     PROCEDURE CheckOlNew1()
;
;this procedure allows cashiers to signon after the exited program
;without signing off
;
;*********************************************************************

PROC CheckOlNew1()

VIEW "ONOFLOG1"                                    ;see if last cashier
END                                                ;signed off system
IF ISBLANK([Date-Off]) THEN                        ;if not
   CASHNAM1=[Cashier]                              ;prompt for password
   CLEARALL                                        ;and if thats right
   ASKEM1()                                        ;return cashier to
   ??" ",CASHNAM1," Welcome back please enter password "
   CANVAS OFF                                        ;program otherwise exit
   ACCEPT "A6" TO CHKPW1
   CLEAR
   CANVAS ON


   IF NOT ISASSIGNED(CHKPW1) THEN
     MESSAGE "ESCAPE KEY NOT ACTIVE IN THE SIGNON MODE........."
     SLEEP 3000
     EXIT
   ENDIF


   VIEW "CASHIER1"
   SCAN
     IF CASHNAM1=[Cashier Name] THEN
```

```
      TPW1=[Password]
    ENDIF
  ENDSCAN
  CLEARALL
  CLEAR
  IF CHKPW1=TPW1 THEN
     OLDCASH1=1
     ELSE OLDCASH1=2
          MESSAGE "HAPPENED HERE"
          SLEEP 1000
  ENDIF
ENDIF
CLEARALL

ENDPROC

;*********************************************************************



;*********************************************************************
;                    PROCEDURE NewSignon1()
;
;this procedures allows ticket cashiers to signon to the program
;
;*********************************************************************

PROC NewSignon1()


ASKEM1()                                    ;clear screen for user input
??"Enter Cashier Number "                   ;prompt for cashier number

ACCEPT "N" TO CASHNUM1                      ;accept input
IF NOT ISASSIGNED(CASHNUM1) THEN
  MESSAGE "ESCAPE KEY NOT ACTIVE IN SIGNON MODE EXITING........"
  SLEEP 3000
  EXIT
ENDIF
CLEAR                                       ;clear screen
GOODTOGO1=0
GOODNUM1=0                                  ;assume number was wrong

VIEW "CASHIER1"                             ;scan for the cashier number
  SCAN                                      ;
    IF CASHNUM1=[Cashier Number] THEN       ;if its in cashier 1 table
      GOODNUM1=1                            ;assume for now number was right
      CASHNAM1=[Cashier Name]               ;get cashier name, password,
      PW1=[Password]                        ;and transaction file
```

A:\signon1.sc Page 3

```
      IF NOT ISASSIGNED(PW1) THEN
         MESSAGE "ESCAPE KEY NOT VALID IN SIGNON MODE EXITING........."
         SLEEP 3000
      ENDIF
      FNAME1=[File Name]                    ;
    ENDIF                                   ;
  ENDSCAN                                   ;
IF GOODNUM1=1 THEN
  CLEARALL                                    ;
  ASKEM1()                                    ;
  TRUPASS1=0                                  ;
  ??CASHNAM1, " Please Enter Password "       ;if user got this far
  CANVAS OFF                                  ;prompt them for a password and
  ACCEPT "A6" TO CHKPW1                       ;hide the input
  CLEAR                                       ;
  IF NOT ISASSIGNED(CHKPW1) THEN
    MESSAGE "ESCAPE KEY NOT ACTIVE IN THIS MODE EXITING..........."
    EXIT
  ENDIF
  IF CHKPW1=PW1 THEN                          ;if the password is correct
    TRUPASS1=1
    ASKEM1()
    CANVAS ON
    ??"Enter Beginning Bank "
    CANVAS ON
    ACCEPT "$" TO BANK1
    IF NOT ISASSIGNED(BANK1) THEN
      MESSAGE "ESCAPE KEY NOT ACTIVE EXITING........."
      SLEEP 1000
      EXIT
    ENDIF
    EDIT "ONOFLOG1"                           ;log information in the
    END DOWN                                  ;onofflog table
    [Cashier-#]=CASHNUM1
    [Cashier]=CASHNAM1
    [Date-On]=TODAY()
    [Time-On]=TIME()
    DO IT!
    CLEARALL
                                              ;and record it in the transaction
    EMPTY "CURRENT1"                          ;record this cashiers
    EDIT "CURRENT1"                           ;transaction file
    [File-Name]=FNAME1
    DO IT!
    CLEARIMAGE
    EDIT FNAME1                               ;table
      END                                     ;
      [Date]=TODAY()
      [Time]=TIME()
      [Transaction-Code]="S"
      [Verification-#]="Begin Shift"
      [Amount-Paid]=0
```

A:\signon1.sc Page 4

```
      [Amount-Added]=BANK1
      [Balance]=BANK1
    DO_IT!
    CLEARALL
    CLEAR
                                        ;run the program

  ENDIF
ENDIF
IF (GOODNUM1=1) AND (TRUPASS1=1) THEN
  GOODTOGO1=1
ELSE OLDCASH1=2
ENDIF
ENDPROC

;*********************************************************************
;                          MAIN PROGRAM
;allows cashiers to signon
;


OLDCASH1=0            ;tag for new or old signon
CheckOlNew1()         ;check
IF OLDCASH1=0 THEN    ;if tag still 0 indicates a new signon
  NewSignon1()        ;run NewSignon1 procedure
  IF GOODTOGO1=1 THEN
    RELEASE VARS CASHNAM1,CHKPW1,OLDCASH1,CASHNUM1,GOODNUM1,PW1,FNAME1,TRUPASS1,
    RELEASE PROCS ASKEM1,CheckOlNew1,NewSignon1
    CLEARALL
    CLEAR
    PLAY "CASHIER1"
  ENDIF
ENDIF
IF OLDCASH1=1 THEN    ;if its 1

  RELEASE VARS CASHNAM1,CHKPW1,OLDCASH1,CASHNUM1,GOODNUM1,PW1,FNAME1,TRUPASS1,BA
  RELEASE PROCS ASKEM1,CheckOlNew1,NewSignon1
  PLAY "CASHIER1"

ENDIF
IF OLDCASH1=2 THEN    ;if its 2 then cannot determine exit
  MESSAGE "Incorrect password or cashier number exiting program..."
  SLEEP 2000
  RELEASE VARS CASHNAM1,CHKPW1,OLDCASH1,CASHNUM1,GOODNUM1,PW1,FNAME1,TRUPASS1,BA
  RELEASE PROCS ASKEM1,CheckOlNew1,NewSignon

  EXIT
ENDIF
;*************************************************************************
```

A:\sshift1.sc Page 1

```
;*********************************************************************
;SSHIFT1.SC
;Copyright 1995 New Gaming Systems Inc.
;*********************************************************************

PROC SeeIfLead()

ISLEAD=0

VIEW "CURRENT1"

FNAME=[File-Name]
CLEARALL
VIEW "CASHIER"
SCAN
  IF [File Name]=FNAME THEN
    IF [Lead Cashier]="Y" THEN
      ISLEAD=1
    ENDIF
  ENDIF
ENDSCAN
CLEARALL
ENDPROC
;*********************************************************************
;
PROC GetTheInf(FNAMEX)
  VIEW "CASHIER"
  SCAN
  IF [File Name]=FNAMEX THEN
    CASHNUM=[Cashier Number]
    CASHNAM=[Cashier Name]
    LEAD=[Lead Cashier]
  ENDIF
  ENDSCAN
  CLEARALL
  TOTFILL=0
  TOTCHIP=0
  TOTPAY=0
  VIEW FNAMEX
  SCAN
  IF ([Transaction-Code]="S") OR ([Transaction-Code]="B") THEN
    TOTFILL=TOTFILL+[Amount-Added]
  ENDIF
  IF ([Transaction-Code]="C") THEN
    TOTCHIP=TOTCHIP+[Amount-Added]
  ENDIF
  IF ([Transaction-Code]="A") THEN
    TOTPAY=TOTPAY+[Amount-Paid]
  ENDIF
  ENDSCAN
  VIEW "CASHREP"
  IF ISEMPTY("CASHREP") THEN
```

A:\sshift1.sc Page 2

```
    EDIT "CASHREP"
  ELSE
    EDIT "CASHREP"
    END DOWN
  ENDIF
  [Cashier Number]=CASHNUM
  [Cashier Name]=CASHNAM
  [Lead Cashier]=LEAD
  [Fills]=TOTFILL
  [Chips]=TOTCHIP
  [Payouts]=TOTPAY
  [Balance]=TOTFILL-TOTPAY
  DO_IT!

ENDPROC
;*************************************************************************
SeeIfLead()

IF ISLEAD=0 THEN
  MESSAGE "Only lead cashiers can use this function...."
ENDIF

IF ISLEAD=1 THEN
  MESSAGE "Accumulating shift totals..."
  BIGTF=0
  BIGTP=0
  BIGTC=0
  EMPTY "CASHREP"
  GetTheInf(FNAME)
  BIGTF=BIGTF+TOTFILL
  BIGTP=BIGTP+TOTPAY
  BIGTC=BIGTC+TOTCHIP
  VIEW "CURRENT2"
  FNAME2={File-Name}
  CLEARALL
  GetTheInf(FNAME2)
  BIGTF=BIGTF+TOTFILL
  BIGTP=BIGTP+TOTPAY
  BIGTC=BIGTC+TOTCHIP
  CLEARALL
  VIEW "CURRENT3"
  FNAME3={File-Name}
  GetTheInf(FNAME3)
  BIGTF=BIGTF+TOTFILL
  BIGTP=BIGTP+TOTPAY
  BIGTC=BIGTC+TOTCHIP
  ADD "CASHREP" "DAYACT"

  EDIT "CASHREP"
  END DOWN DOWN
  [Cashier Name]="Totals"
  [Fills]=BIGTF
```

A:\sshift1.sc Page 3

```
  [Chips]=BIGTC
  [Payouts]=BIGTP
  [Balance]=BIGTF-BIGTP
  DO_IT!
  MESSAGE "Printing cashier report..."
  SLEEP 1500
Menu {Report} {Output} {Cashrep} {2} {Printer}
Menu {Scripts} {End-Record}
  CLEARALL

  MESSAGE "Swing shift lead cashier should signoff now let the grave shift begin
ENDIF
RELEASE VARS FNAME,ISLEAD,TOTFILL,TOTPAY,TOTCHIP,FNAME2,FNAME3,FNAMEX,LEAD,CASHN
RELEASE PROCS SeeIfLead,GetTheInf
```

NGS VSIS

8/23/95 List of PAL scripts for the Drop Program Page 1

Copyright 1995 New Gaming Systems Inc.

| Name | Description |
|---|---|
| Close | Provides daily drop report and saves daily drop information. |
| Dropprog | Provides the menu that invokes all other scripts. |
| Inzero | Zeroes out previous days drop totals. |
| Lookup | Allows user to lookup previously entered drop values. |
| Reprt | Provides daily drop report. |
| Senddrop | Sends drop report to the printer. |
| Thedrop | Allows the user to enter drop information. |

A:\close.sc Page 1

```
;*********************************************************************
;                                CLOSE.SC
; this scripe provides a closing drop report and daily drop information
;Copyright 1995 New Gaming Systems Inc.
;*********************************************************************
CLEARALL CLEAR
PLAY "REPRT"
MESSAGE "Please insert daily drop disk into drive a: "
SLEEP 5000
CLEAR
@10,15 ??"Is disk inserted in drive a: Y/N "
ACCEPT "A1" TO DISKANS
IF (DISKANS="Y") OR (DISKANS="y") THEN
  IF DRIVESTATUS("A") THEN
     MESSAGE "Copying Daily drop file to a:droptab "
     SLEEP 1000
     COPY "DROPTAB" "A:DROPTAB"
     PLAY "INZERO"
  ELSE MESSAGE "DRIVE NOT READY......"
       SLEEP 1000
  ENDIF
ENDIF
RELEASE VARS DISKANS
CLEAR
```

A:\dropprog.sc Page 1

```
;*********************************************************************
;                              DROPPROG.SC
;This script provides the menu that invokes all other scripts.
;Copyright 1995 New Gaming Systems Inc.
;*********************************************************************


CLEAR
WHILE TRUE
  CLEAR
  SHOWMENU
  "Input" : "Input Machine Drop",
  "Lookup" : "View drop file",
  "Report" : "Print Report on Drop",
  "Close" : "Finalize Daily Drop and Save Days Data",
  "Quit" : "Leave Program"
  TO Choice
  SWITCH
    CASE Choice="Input" : PLAY "THEDROP"
    CASE Choice="Lookup" : PLAY "LOOKUP"
    CASE Choice="Report" : PLAY "REPRT"
    CASE Choice="Close" : PLAY "CLOSE"
    CASE Choice="Quit" : EXIT
  ENDSWITCH
  CLEAR
ENDWHILE
```

A:\inzero.sc Page 1

```
;*********************************************************************
;                              INZERO.SC
;
;This script zeroes out all previous days drop values.
;Copyright 1995 New Gaming Systems Inc.
;*********************************************************************

W=NRECORDS("DROPTAB")
CLEARALL
CLEAR
EDIT "DROPTAB"
FOR K FROM 1 TO W
  [Ones]=0
  [Twos]=0
  [Fives]=0
  [Tens]=0
  [Twenties]=0
  [Total]=0
  DOWN
ENDFOR
DOWN
[Ones]=0
[Twos]=0
[Fives]=0
[Tens]=0
[Twenties]=0
[Total]=0
DO_IT!
CLEARALL
CLEAR
```

A:\lookup.sc Page 1

```
;*********************************************************************
;                          LOOKUP.SC
;
;This script allows the user to lookup drop values per machine.
;Copyright 1995 New Gaming Systems Inc.
;*********************************************************************

VIEW "DROPTAB"
PICKFORM "2"
WAIT TABLE
PROMPT "Use PageUp or PageDown keys to scroll through drop press F2 when finishe
UNTIL "F2"
CLEARALL
CLEAR
```

A:\reprt.sc Page 1

```
;*********************************************************************
;                              REPRT.SC
;
;This script totals drop values and provides a report on daily drop.
;Copyright 1995 New Gaming Systems Inc.
;*********************************************************************


TOT1=0
TOT2=0
TOT5=0
TOT10=0
TOT20=0
BIGTOTS=0
VIEW "DROPTAB"
FOR K FROM 1 TO 151
  TOT1=TOT1+[Ones]
  TOT2=TOT2+[Twos]
  TOT5=TOT5+[Fives]
  TOT10=TOT10+[Tens]
  TOT20=TOT20+[Twenties]
  BIGTOTS=BIGTOTS+[Total]
  DOWN
ENDFOR
EDIT "DROPTAB"
DOWN
[Ones]=TOT1
[Twos]=TOT2
[Fives]=TOT5
[Tens]=TOT10
[Twenties]=TOT20
[Total]=BIGTOTS
DO_IT!
CLEARALL CLEAR
PLAY "SENDDROP"
```

A:\senddrop.sc Page 1

```
;*********************************************************************
;SENDDROP.SC sends the drop report to printer
;Copyright 1995 New Gaming Systems Inc.
;*********************************************************************

MESSAGE "Sending report to printer....."
SLEEP 1000
Menu {Report} {Output} {DROPTAB} {1} {Printer}
Menu {Scripts} {End-Record}
```

A:\thedrop.sc Page 1

```
;*********************************************************************
;                              THEDROP.SC
;
;This script allows the user to enter drop information.
;Copyright 1995 New Gaming Systems Inc.
;*********************************************************************


EMPTY "DROPENT"
EDIT "DROPENT"
PICKFORM "1"
WAIT RECORD
PROMPT "Enter Machine-#, Ones, Twos, Fives, Tens, and Twenties then press F2"
UNTIL "F2"
[Total]=([Ones]*1) + ([Twos]*2) + ([Fives]*5) + ([Tens]*10) + ([Twenties]*20)
MACNUM=[Machine-#]
C1=[Ones]
C2=[Twos]
C5=[Fives]
C10=[Tens]
C20=[Twenties]
TOTS=[Total]
DO_IT!
CLEARALL
CLEAR
VIEW "DROPENT"
PICKFORM "2"
WAIT RECORD
PROMPT "Press F2 to continue"
UNTIL "F2"
@22,15
??"Record Transaction Y/N ? "
ACCEPT "A1" TO RECANS
CLEARALL
CLEAR
IF RECANS="Y" OR RECANS="y" THEN
  VIEW "DROPTAB"
  SCAN
  IF [Machine-#]=MACNUM THEN
    EDIT "DROPTAB"
    [Ones]=C1
    [Twos]=C2
    [Fives]=C5
    [Tens]=C10
    [Twenties]=C20
    [Total]=TOTS
    DO_IT!
  ENDIF
  ENDSCAN
ENDIF
```

A:\thedrop.sc Page 2

```
CLEARALL
CLEAR
RELEASE VARS C1,C5,C10,C20,TOTS,RECANS
```

APPENDIX C

NGS VSIS

8/23/95 Slot accounting office PAL Scripts Page 1

Copyright 1995 New Gaming Systems Inc.

| Name | Description |
|---|---|
| Change | Allows user to make changes to machine master file. |
| Convert | Converts cage transaction file to slot accounting transactio file for auditing purposes. |
| Cyotrun | Runs daily, week to date, month to date and year to date totals for all machines. |
| Daily | Runs daily meter reading and drop report and creates a file for further processing. |
| Del1st | A report design script. |
| Del2nd | A report design script. |
| Delfirst | A report design script. |
| Desnsen3 | A report design script. |
| Drop | Loads vault drop data and provides a drop report. |
| Finltick | Runs final cashier summary and voucher payout report. |
| Flag | Flags losing machines over a specified time period. |
| Fnlrun2 | Processes voucher data as invoked by finltick.sc. |
| Input | Allows user to input reconciliation data. |
| Inzero | Zeroes out cashiers previous days data. |
| Loadinp | Invoked by INPUT.SC this script loads reconciliation file. |
| Lookinc | Allows user to lookup machine income information. |
| Lookmas | Allows the user to view machine master file information. |
| Locktot | Allows users to lookup daily machine totals. |
| Meters | Allows user to manually input meter readings. |
| Monthzip | Clears monthly machine totals. |
| Newday | Saves previous days information and clears files for another days processing. |

NGS VSIS

8/23/95 Slot accounting office PAL Scripts Page 2

Copyright 1995 New Gaming Systems Inc.

| Name | Description |
|---|---|
| Ngsvsis | The menu that drives all these scripts. |
| Outstat | Sends machine status report to printer. |
| Prep1 | Prompts users for beginning and ending dates for various reports. |
| Prntit | Prints an individuals transaction report. |
| Prntrans | Invokes PRNTIT.SC |
| Runsum | Runs a periodic summary report on machines. |
| Senday | Sends daily report to printer. |
| Senddrop | Sends drop report to printer. |
| Sendit | Sends reconciliation report to the printer. |
| Sendrep | Sends shift report to printer. |
| Sendrep2 | Sends closing shift report to the printer. |
| Sendsum | Sends cashier summary report to the printer. |
| Sortdrop | Sorts the drop file by machine number. |
| Sortflag | Sorts the flag report by machine. |
| Summary | Invokes the RUNSUM.SC |
| Sumsend | Sends periodic machine summary report to printer. |
| Tabrecon | Runs a daily machine reconciliation. |
| Theanls | Runs a machine analysis. |
| Tickets | Processes audited voucher information. |
| Totaltd | Runs daily totals to date. |
| Update | Updates machine master file after a reconciliation. |
| Weekzip | Clears weekly totals. |
| Yearzip | Clears yearly machine totals. |

A:\change.sc Page 1

```
;*********************************************************************
;CHANGE.SC allows users to make changes to machine masterfiles
;Copyright 1995 New Gaming Systems Inc.
;*********************************************************************

PROC ASKEM()
CLEAR @10,15
ENDPROC

ACCNUM=1
VIEW "LOCATION"
SCAN FOR [ACCOUNT-#]=ACCNUM
  MASFILE=[MASTER TABLE]
ENDSCAN
CLEARALL
EDIT MASFILE
PICKFORM "F"
WAIT TABLE
PROMPT"Page Up or Page Down to Machine Record to Edit Machine Information"

UNTIL "F2"
DO IT!
CLEAR
CLEARALL
RELEASE VARS ALL
RELEASE PROCS ALL
```

A:\convert.sc Page 1

```
;*********************************************************************
;
;CONVERT.SC converts cage transaction file to accounting transaction file
;for auditing purposes.
;Copyright 1995 New Gaming Systems Inc.
;*********************************************************************


EMPTY "CONVERT"
EDIT "CONVERT"
WAIT RECORD
PROMPT "Enter source and destination tables then press F2"
UNTIL "F2"
DO_IT!
SNAME=[Source-File]
DNAME=[Destination-File]
W=0
VIEW SNAME
SCAN
IF [Transaction-Code]="A" THEN
  W=W+1
ENDIF
ENDSCAN
CLEARALL
CLEAR
ARRAY MACNUM[W]
ARRAY PAYOUT[W]
I=1
VIEW SNAME
SCAN
IF [Transaction-Code]="A" THEN
   MACNUM[I]=[Machine-#]
   PAYOUT[I]=[Amount-Paid]
   I=I+1
ENDIF
ENDSCAN
CLEARALL
EDIT DNAME
FOR K FROM 1 TO W
  [MACHINE-#]=MACNUM[K]
  [PAYOUT]=PAYOUT[K]
  DOWN
ENDFOR
DO_IT!
```

A:\cyotrun.sc Page 1

```
;*********************************************************************
;Copyright 1995 New Gaming Systems Inc.
;CYOTRUN.SC runs daily, week to date, month to date and year to date
;totals per machine.
;*********************************************************************


EMPTY "ENTRYFIL"
EDIT "ENTRYFIL"
WAIT RECORD
PROMPT "Enter date and file name then press F2"
UNTIL "F2"
DO_IT!
DAT=[DATE]
PCNTFILE=[FILE-NAME]
CLEARALL
CLEAR
Z=NRECORDS("COYOTE")
;Z=290
ARRAY IN[Z]
ARRAY OUT[Z]
TOTDIN=0
TOTDOUT=0
TOTWIN=0
TOTWOUT=0
TOTMIN=0
TOTMOUT=0
TOTYIN=0
TOTYOUT=0
VIEW PCNTFILE
;DAT= 7/02/95
SCAN
I=[MACHINE-#]
IF (I<(Z+1)) AND (I>0) THEN
IN[I]=[DROP]
OUT[I]=[PAYOUT]
ENDIF
ENDSCAN
CLEARALL
EDIT "CYOTPCNT"
FOR K FROM 1 TO Z
[Date]=DAT
[Daily-Handle]=IN[K]
[Daily-Payout]=OUT[K]
[Daily-Win]=IN[K]-OUT[K]
[Daily-Percent]=100*(OUT[K]/IN[K])
TOTDIN=TOTDIN+IN[K]
TOTDOUT=TOTDOUT+OUT[K]
[Weekly-Handle]=[Weekly-Handle]+IN[K]
[Weekly-Payout]=[Weekly-Payout]+OUT[K]
[Weekly-Win]=[Weekly-Handle]-[Weekly-Payout]
```

A:\cyotrun.sc Page 2

```
[Weekly-Percent]=100*([Weekly-Payout]/[Weekly-Handle])
TOTWIN=TOTWIN+[Weekly-Handle]
TOTWOUT=TOTWOUT+[Weekly-Payout]
[Monthly-Handle]=[Monthly-Handle]+IN[K]
[Monthly-Payout]=[Monthly-Payout]+OUT[K]
[Monthly-Win]=[Monthly-Handle]-[Monthly-Payout]
[Monthly-Percent]=100*([Monthly-Payout]/[Monthly-Handle])
TOTMIN=TOTMIN+[Monthly-Handle]
TOTMOUT=TOTMOUT+[Monthly-Payout]
[Yearly-Handle]=[Yearly-Handle]+IN[K]
[Yearly-Payout]=[Yearly-Payout]+OUT[K]
[Yearly-Win]=[Yearly-Handle]-[Yearly-Payout]
[Yearly-Percent]=100*([Yearly-Payout]/[Yearly-Handle])
;[Yearly-NGS]=[Yearly-Win]*.25
TOTYIN=TOTYIN+[Yearly-Handle]
TOTYOUT=TOTYOUT+[Yearly-Payout]
DOWN
ENDFOR
;DOWN
;DOWN
[Date]=DAT
[Daily-Handle]=TOTDIN
[Daily-Payout]=TOTDOUT
[Daily-Win]=TOTDIN-TOTDOUT
[Daily-Percent]=100*(TOTDOUT/TOTDIN)
[Weekly-Handle]=TOTWIN
[Weekly-Payout]=TOTWOUT
[Weekly-Win]=TOTWIN-TOTWOUT
[Weekly-Percent]=100*(TOTWOUT/TOTWIN)
[Monthly-Handle]=TOTMIN
[Monthly-Payout]=TOTMOUT
[Monthly-Win]=TOTMIN-TOTMOUT
[Monthly-Percent]=100*(TOTMOUT/TOTMIN)
[Yearly-Handle]=TOTYIN
[Yearly-Payout]=TOTYOUT
[Yearly-Win]=TOTYIN-TOTYOUT
[Yearly-Percent]=100*(TOTYOUT/TOTYIN)
;[Yearly-NGS]=(TOTYIN-TOTYOUT)*.25
DO_IT!
MESSAGE "Sending machine status report to printer...."
PLAY "OUTSTAT"
CLEARALL
CLEAR
ADD "CYOTPCNT" "BIGCYOT"
CLEARALL
CLEAR
RELEASE VARS ALL
RELEASE PROCS ALL
```

A:\daily.sc Page 1

```
;*********************************************************************
;Copyright 1995 New Gaming Systems Inc.
;DAILY.SC runs daily meter reading and drop report and creates a file
;for further processing.
;*********************************************************************


PROC ASKEM()
  CLEAR
  @10,15
ENDPROC

ASKEM()
??"Enter activity Date "
ACCEPT "D" TO COLDAT
CLEAR
CLEARALL
Z=NRECORDS("COYOTE")
ARRAY INMETER[Z]
ARRAY OUTMETER[Z]
ARRAY DROP[Z]
ARRAY PAYOUT[Z]
FOR H FROM 1 TO Z
  INMETER[H]=0
  OUTMETER[H]=0
  DROP[H]=0
  PAYOUT[H]=0
ENDFOR

VIEW "METERS"
SCAN
  I=[MACHINE-#]
  INMETER[I]=[IN-METER]
  OUTMETER[I]=[OUT-METER]

ENDSCAN
CLEARALL
FOR J FROM 1 TO Z
  VIEW "DROPTAB"
  SCAN
    IF [MACHINE-#]=J THEN
      DROP[J]=[DROP]

    ENDIF
  ENDSCAN
  CLEARALL
ENDFOR
FOR K FROM 1 TO Z
  VIEW "SHIFTREP"
  SCAN
    IF [Machine-#]=K THEN
      PAYOUT[K]=[Amount-Paid]
```

A:\daily.sc Page 2

```
    ENDIF
  ENDSCAN
  CLEARALL
ENDFOR
CLEARALL
TOTDROP=0
TOTPAY=0
EMPTY "DAILY"
EDIT "DAILY"
FOR L FROM 1 TO Z
  [MACHINE-#]=L
  [IN-METER]=INMETER[L]
  [OUT-METER]=OUTMETER[L]
  [DROP]=DROP[L]
  [PAYOUT]=PAYOUT[L]
  TOTDROP=TOTDROP+DROP[L]
  TOTPAY=TOTPAY+PAYOUT[L]
  [NET]=DROP[L]-PAYOUT[L]
  DOWN
ENDFOR
END
DOWN
[DROP]=TOTDROP
[PAYOUT]=TOTPAY
[NET]=TOTDROP-TOTPAY
DO_IT!
CLEARALL
PLAY "SENDAY"
RELEASE VARS ALL
RELEASE PROCS ALL
```

A:\del1st.sc Page 1

```
;*********************************************************************
;Copyright 1995 New Gaming Systems Inc.
;DEL1ST.SC
;*********************************************************************
{Modify} {Edit} {FLAGREP} Del Do_It! ClearImage {Scripts} {End-Record}
```

A:\del2nd.sc Page 1

```
;*********************************************************************
;Copyright 1995 New Gaming Systems Inc.
;DEL2ND.SC
;*********************************************************************

{Modify} {Edit} {SUMFILE} Del Do_It!
Menu Esc ClearImage {Scripts} {End-Record}
```

A:\delfirst.sc Page 1

```
;*********************************************************************
;Copyright 1995 New Gaming Systems Inc.
;DELFIRST.SC
;*********************************************************************

{View} {TEMPREC} EditKey Del Do_It! ClearImage {Scripts} {End-Record}
```

A:\desnsen3.sc Page 1

```
;*********************************************************************
;DESNSEN3.SC
;Copyright 1995 New Gaming Systems Inc.
;*********************************************************************

Menu {Report} {Design} {Flagrep} {2} {Replace}

TYPEIN "REDFLAGS "
TYPEIN BEGDAT
TYPEIN "-"
TYPEIN ENDDAT
ENTER
{Tabular} Menu {Setting} {PageLayout} {Width} {250} Do_It!
IF PRINTERSTATUS() = True THEN
  MESSAGE "PRINTING RED FLAGS..."
  Menu
  {Report} {Output} {Flagrep} {2} {Printer} Menu {Scripts} {End-Record}
  ELSE MESSAGE "PRINTER NOT READY..."
ENDIF
```

A:\drop.sc Page 1

```
;*********************************************************************
;DROP.SC loads drop data accumulated in the vault and provides a drop
;report.
;Copyright 1995 New Gaming Systems Inc.
;*********************************************************************


PROC ASKEM()
  CLEAR
  @10,15
ENDPROC

ASKEM()
??"Enter Collection Date "
ACCEPT "D" TO COLDAT
W=NRECORDS("COYOTE")
ARRAY MACHINE[W]
ARRAY AMOUNT[W]
VIEW "A:DROPTAB"
V=1
FOR X FROM 1 TO W
MACHINE[X]=[Machine-#]
AMOUNT[X]=[Total]
DOWN
ENDFOR
CLEARALL
EDIT "DROPTAB"
FOR Y FROM 1 TO W
[MACHINE-#]=MACHINE[Y]
[DROP]=AMOUNT[Y]
DOWN
ENDFOR
HOME

WAIT TABLE
PROMPT "Enter Machine Number and drop amount press F2 when finished"
UNTIL "F2"
DO_IT!
PLAY "SORTDROP"
EMPTY "DROPREP"
ADD "DROPTAB" "DROPREP"
CLEAR
CLEARALL
TOTDROP=0
VIEW "DROPREP"
SCAN
  TOTDROP=TOTDROP+[DROP]
ENDSCAN
EDIT "DROPREP"
END DOWN
[DROP]=TOTDROP
DO_IT!
```

A:\drop.sc Page 2

```
CLEARALL
@10,15
??"Print Drop Report Y/N ? "
ACCEPT "A1" TO DROPANS
IF DROPANS="Y" OR DROPANS="y" THEN
  PLAY "SENDDROP"
ENDIF
CLEARALL
CLEAR
RELEASE PROCS ALL
RELEASE VARS ALL
```

A:\finltick.sc Page 1

```
;*********************************************************************
;FINLTICK.SC runs final cashier summary and voucher payout report.
;Copyright 1995 New Gaming Systems Inc.
;*********************************************************************


PROC CLEANIT()
  CLEAR @10,15
ENDPROC
CLEANIT()
??"Enter Activity Date "
ACCEPT "D" TO COLDAT
EDIT "CASHREP"
END
[Number Tickets]=0
[Total Payouts]=0
DO_IT!
CLEARALL
BIGTK=0
BIGPY=0
VIEW "CASHREP"
SCAN
BIGTK=BIGTK+[Number Tickets]
BIGPY=BIGPY+[Total Payouts]
ENDSCAN
EDIT "CASHREP"
END
[Number Tickets]=BIGTK
[Total Payouts]=BIGPY
DO_IT!
PLAY "SENDSUM"
EMPTY "TICKETS"
VIEW "CASHIER"
W=NRECORDS("CASHIER")
ARRAY FNAME[W]
I=1
SCAN
 FNAME[I]=[File Name]
 I=I+1
ENDSCAN
FOR K FROM 1 TO W
  ADD FNAME[K] "TICKETS"
ENDFOR
CLEARALL
PLAY "FNLRUN2"
CLEAR
CLEARALL
RELEASE PROCS ALL
RELEASE VARS ALL
```

A:\flag.sc Page 1

```
;*********************************************************************
;FLAG.SC flags losing machines over a specific time period.
;Copyright 1995 New Gaming Systems Inc.
;*********************************************************************


PROC TABIT(DAT,LOC,MACH,RCI,RCO,RGP,OVUN)
  EDIT "FLAGREP"
  END DOWN
  [DATE]=DAT
  [LOCATION]=LOC
  [MACHINE]=MACH
  [REAL-CASH-IN]=RCI
  [REAL-CASH-OUT]=RCO
  [REAL-GROSS-PROFIT]=RGP
  [OVER/UNDER]=OVUN
;  [NGS-NET]=NGS
  DO_IT!
  UPIMAGE
ENDPROC

EMPTY "FLAGREP"
PLAY "PREP1"
IF GOOD=1 THEN
  CLEAR
  MESSAGE BEGDAT," ",ENDDAT," ",ACCNUM
  SLEEP 2000
  VIEW "LOCATION"
  SCAN FOR ACCNUM=[ACCOUNT-#]
    MASFILE=[MASTER TABLE]
    LOC=[LOCATION]
    DATFILE=[REPORT FILE]
  ENDSCAN
  CLEARALL
;  MESSAGE LOC," ",MASFILE," ",DATFILE
;  SLEEP 2000
  DATONE=(BEGDAT-1)
  DATTWO=(ENDDAT+1)
  MESSAGE "FLAGGING LOSING MACHINES..."
  VIEW DATFILE
    SCAN
      IF ([DATE]>DATONE) AND ([DATE]<DATTWO) THEN
        IF [REAL-GROSS-PROFIT]<0 THEN
          DAT=[DATE]
          MACH=[MACHINE]
          RCI=[REAL-CASH-IN]
          RCO=[REAL-CASH-OUT]
          RGP=[REAL-GROSS-PROFIT]
          OVUN=[OVER/UNDER]
;          NGS=[NGS-NET]
          TABIT(DAT,LOC,MACH,RCI,RCO,RGP,OVUN)
```

A:\flag.sc Page 2

```
        ENDIF
      ENDIF
    ENDSCAN
  PLAY "SORTFLAG"
  PLAY "DEL1ST"
  PLAY "DESNSEN3"
ENDIF
CLEARALL
CLEAR
RELEASE VARS ALL
RELEASE PROCS ALL
```

A:\fnlrun2.sc Page 1

```
;*********************************************************************
;FNLRUN2.SC process voucher data is invoked by FINLTICK.SC
;Copyright 1995 New Gaming Systems Inc.
;*********************************************************************


PROC THEPROMPT()
   CLEAR
   @10,15
ENDPROC

Z=NRECORDS("COYOTE")

ARRAY NUMTICKS[Z]
ARRAY PAYOUT[Z]
FOR I FROM 1 TO Z
  NUMTICKS[I]=0
  PAYOUT[I]=0
ENDFOR


  VIEW "TICKETS"
  SCAN
  I=INT([MACHINE-#])
    IF (I<0) OR (I>Z) THEN
       I=Z
    ENDIF
    PAYOUT[I]=PAYOUT[I]+[PAYOUT]
    NUMTICKS[I]=NUMTICKS[I]+1
    MESSAGE "PROCESSING DATA..."
    SLEEP 100
  ENDSCAN
  CLEARALL

EMPTY "ENDSHIFT"
EDIT "ENDSHIFT"
FOR L FROM 1 TO Z
  [Machine-#]=L
  [Number of Tickets]=NUMTICKS[L]
  [Amount-Paid]=PAYOUT[L]
  DOWN
ENDFOR
DO IT!
EMPTY "SHIFTREP"
ADD "ENDSHIFT" "SHIFTREP"
CLEARALL
TOTTICKS=0
TOTPAY=0
VIEW "SHIFTREP"
SCAN
  TOTTICKS=TOTTICKS+[Number of Tickets]
```

A:\fnlrun2.sc Page 2

```
  TOTPAY=TOTPAY+[Amount-Paid]
ENDSCAN
EDIT "SHIFTREP"
END DOWN
[Number of Tickets]=TOTTICKS
[Amount-Paid]=TOTPAY
DO IT!
CLEARALL
PLAY "SENDREP2"
RELEASE PROCS ALL
RELEASE VARS ALL
```

A:\input.sc Page 1

```
;*********************************************************************
;INPUT.SC allows users to input reconciliation data.
;Copyright 1995 New Gaming Systems Inc.
;*********************************************************************


PROC ASKEM()
CLEAR @10,15
ENDPROC

ASKEM()
??"ENTER N FOR NEW DAY OR O FOR OLD DAY "
ACCEPT "A1" TO DAYANS
IF (DAYANS = "N") OR (DAYANS = "n") THEN
  PLAY "LOADINP"
ENDIF
ASKEM()
??"ENTER RECONCILIATION DATE "
ACCEPT "D" TO RECDATE
ACCNUM=6
EDIT "M&M"
PICKFORM "2"
K=[ID-#]
IF RECNO()>0 THEN
MOVETO [COINSIN]
ENDIF
WAIT TABLE
PROMPT"ENTER METER READINGS AND MONEY AMOUNTS THEN PRESS F2 WHEN FINSISHED"
UNTIL "F2"
DO_IT!
CLEARALL
;ASKEM()
;??"FINISHED WITH ENTRY FOR ",RECDATE," ? Y/N "
;ACCEPT "A1" TO RENANS
;IF (RENANS="Y") OR (RENANS="y") THEN
;  PLAY "NAMEFILE"
;ENDIF
;RELEASE VARS ALL
;RELEASE PROCS ALL
CLEAR
```

A:\inzero.sc Page 1

```
;*********************************************************************
;INZERO.SC zeroes out previous days cashier totals.
;Copyright 1995 New Gaming Systems Inc.
;*********************************************************************


EDIT "CASHREP"
FOR K FROM 1 TO 28
[Number Tickets]=0
[Total Payouts]=0
DOWN
ENDFOR
DO_IT!
```

A:\loadinp.sc Page 1

```
;*********************************************************************
;LOADINP.SC invoked by INPUT.SC this script loads the daily meter reading
;and drop report into the reconciliation file.
;Copyright 1995 New Gaming Systems Inc.
;*********************************************************************


CLEARALL
RELEASE VARS ALL

EDIT "CHNGFILE"
WAIT RECORD
PROMPT "ENTER FILE NAME TO LOAD THEN PRESS F2"
UNTIL "F2"
DO_IT!
FNAME=[FILENAME]
CLEARALL
CLEAR
W=NRECORDS("COYOTE")
ARRAY CIN[W]
ARRAY COT[W]
ARRAY DROP[W]
ARRAY PAY[W]

VIEW FNAME
FOR K FROM 1 TO W
  CIN[K]=[IN-METER]
  COT[K]=[OUT-METER]
  DROP[K]=[DROP]
  PAY[K]=[PAYOUT]
  DOWN
  MESSAGE CIN[K]," ",K
  SLEEP 200

ENDFOR
CLEARALL
CLEAR
EDIT "M&M"
FOR J FROM 1 TO W
  [ID-#]=J
  [COINSIN]=CIN[J]
  [COINSOUT]=COT[J]
  [AMT-COLLECTED]=DROP[J]
  [AMT-PAID]=PAY[J]
  [JACKPOTS]=0
  DOWN
ENDFOR
DO_IT!
CLEARALL
CLEAR
```

A:\lookinc.sc Page 1

```
;*********************************************************************
;LOOKINC.SC allows the user to lookup machine income information.
;Copyright 1995 New Gaming Systems Inc.
;*********************************************************************


VIEW "CYOTPCNT"
PICKFORM "F"
PROMPT "Use page up and page down keys to view machine information then press F2
WAIT TABLE
UNTIL "F2"
CLEARALL
CLEAR
```

A:\lookmas.sc Page 1

```
;*********************************************************************
;LOOKMAS.SC allows the user to lookup machine master file information.
;Copyright 1995 New Gaming Systems Inc.
;*********************************************************************


VIEW "COYOTE"
PICKFORM "F"
PROMPT "Use page up and page down keys to view machine master record then press
WAIT TABLE
UNTIL "F2"
CLEARALL
CLEAR
```

A:\looktot.sc Page 1

```
;*********************************************************************
;LOOKTOT.SC allows users to lookup daily machine totals.
;Copyright 1995 New Gaming Systems Inc.
;*********************************************************************


VIEW "TOTREP"
PICKFORM "F"
PROMPT "Use page up and page down keys to view daily totals then press F2"
WAIT TABLE
UNTIL "F2"
CLEARALL
CLEAR
```

A:\meters.sc Page 1

```
;*********************************************************************
;METERS.SC allows users to manually input machine meter readings.
;Copyright 1995 New Gaming Systems Inc.
;*********************************************************************



PROC ASKEM()
CLEAR
@10,15
ENDPROC
ASKEM()
??"Enter Activity Date "
ACCEPT "D" TO ACTDATE

EDIT "METERS"
WAIT TABLE
PROMPT "Enter Machine Number and Meter Readings press F2 when finished"
UNTIL "F2"
DO IT!
CLEAR
CLEARALL
RELEASE PROCS ALL
RELEASE VARS ALL
```

A:\meters.sc Page 1

```
;*********************************************************************
;METERS.SC allows users to manually input machine meter readings.
;Copyright 1995 New Gaming Systems Inc.
;*********************************************************************



PROC ASKEM()
CLEAR
@10,15
ENDPROC
ASKEM()
??"Enter Activity Date "
ACCEPT "D" TO ACTDATE

EDIT "METERS"
WAIT TABLE
PROMPT "Enter Machine Number and Meter Readings press F2 when finished"
UNTIL "F2"
DO IT!
CLEAR
CLEARALL
RELEASE PROCS ALL
RELEASE VARS ALL
```

A:\monthzip.sc Page 1

```
;*********************************************************************
;MONTHZIP.SC clears machine monthly totals.
;Copyright 1995 New Gaming Systems Inc.
;*********************************************************************


W=NRECORDS("CYOTPCNT")
EDIT "CYOTPCNT"
FOR K FROM 1 TO W
  [Monthly-Handle]=0
  [Monthly-Payout]=0
  [Monthly-Win]=0
  [Monthly-Percent]=0
  DOWN
ENDFOR
DO_IT!
```

A:\newday.sc Page 1

```
;*********************************************************************
;NEWDAY.SC saves previous days information and clears totals for the
;next days processing.
;Copyright 1995 New Gaming Systems Inc.
;*********************************************************************


PROC PROMPTEM()
  CLEAR
  @10,15
ENDPROC
PROMPTEM()
??"Enter Name for Daily Report File "
ACCEPT "A8" TO DAYNAME
PROMPTEM()
??"Enter Name for Daily Drop File "
ACCEPT "A8" TO DROPNAME
PROMPTEM()
??"Enter Name for Daily Payout File "
ACCEPT "A8" TO PAYNAME
CLEAR
COPY "DAILY" DAYNAME
COPY "DROPREP" DROPNAME
COPY "SHIFTREP" PAYNAME
EMPTY "TICKS1"
EMPTY "TICKS2"
EMPTY "TICKS3"
EMPTY "TICKS4"
EMPTY "TICKS5"
EMPTY "TICKS6"
EMPTY "TICKS7"
EMPTY "TICKS8"
EMPTY "TICKS9"
EMPTY "TICKS10"
EMPTY "TICKS11"
EMPTY "TICKS12"
EMPTY "TICKS13"
EMPTY "TICKS14"
EMPTY "TICKS15"
EMPTY "TICKS16"
EMPTY "TICKS17"
EMPTY "TICKS18"
EMPTY "TICKS19"
EMPTY "TICKS20"
EMPTY "TICKS21"
EMPTY "TICKS22"
EMPTY "TICKS23"
EMPTY "TICKS24"
EMPTY "TICKS25"
EMPTY "TICKS26"
EMPTY "TICKS27"
```

A:\newday.sc Page 2

```
EMPTY "TICKS28"
EMPTY "DROPTAB"
EMPTY "METERS"
PLAY "INZERO"
CLEARALL
RELEASE VARS ALL
RELEASE PROCS ALL
```

A:\ngsvsis.sc Page 1

```
;*******************************************************************
;                        NGSVSIS SCRIPT
;
;this script provides the main menu for the slot accounting office
;Copyright 1995 New Gaming Systems Inc.
;*******************************************************************
;                           MAIN
;*******************************************************************
`


;RELEASE VARS ALL                ;release variables and procedures
;RELEASE PROCS ALL
CLEAR
WHILE TRUE                       ;show the menu until either exit
CLEARALL                         ;or error occurs
SHOWPULLDOWN

  "Tickets" : "Cash or lookup voucher ticket press ENTER" : "TicketNode"
    SUBMENU
      "Load" : "Load cashiers transaction file press ENTER" : "LoadTrans",
      "Run" : "Edit and process transaction files press ENTER" : "RunTrans",
      "Transactions" : "Print transaction reports press ENTER" : "PrnXion",
      "Final" : "Run final voucher and cashier summary report press ENTER" : "Fi

    ENDSUBMENU,

  "Income" : "Load drop files enter meters print income report press ENTER" : "I
     SUBMENU
       "Drop" : "Process machine drop information press ENTER" : "DropProc",
       "Meters" : "Enter machine meter readings press ENTER" : "MeterProc",
       "Report" : "Run meter reading and machine income report press ENTER" : "M
       "Save" : "Save daily information and clear files for new day press ENTER"
     ENDSUBMENU,

  "Reconcile" : "Reconciliations, master file updates, more press ENTER" : "Reco
     SUBMENU
       "Input" : "Load daily input file or make changes press ENTER" : "ModMnm",
       "Process" : "Reconcile daily information press ENTER" : "ReconRun",
       "Change" : "Make manual changes to master file press ENTER" : "ModGames",
       "Update" : "Update meters to master file press ENTER" : "UpMaster",
       "Total" : "Total to date daily totals file press ENTER" : "TdTotal"
     ENDSUBMENU,

  "Output" : "Summary and various machine reports and more press ENTER" : "RepNo
     SUBMENU
       "Summary" : "Periodic daily summary report press ENTER" : "SumRun",
       "Income" : "Machine income status report press ENTER" : "StatRun",
       "Analysis" : "Machine income anlysis by type press ENTER" : "AlyRun",
       "Flag" : "Periodic report on losing machines press ENTER" : "FlagRun"
     ENDSUBMENU,
```

```
  "Lookup" : "View or scan through various files press ENTER" : "LookNode"
     SUBMENU
       "Income" : "View machine income status file press ENTER" : "IncLook",
       "Totals" : "View daily totals file press ENTER" : "TotLook",
       "Machines" : "View machine master file information press ENTER" : "MacLoo
     ENDSUBMENU,

  "Exit" : "Exit this application" : "Exit1"
     SUBMENU
       "No" : "Do not exit application" : "Exit/No1",
       "ExitParadox" : "Exit to Paradox" : "ExitPar",
       "QuitProgram" : "Exit application press ENTER" : "Exit/Yes1"
     ENDSUBMENU

ENDMENU UNTIL 17              ;Ctrl-Q to Quit


WHILE True
  GETMENUSELECTION KEYTO KeyVar TO MenuItemSelected
    IF Retval THEN
      QUITLOOP
    ENDIF
    IF KeyVar = 17 THEN
      QUITLOOP
    ENDIF
ENDWHILE


SWITCH
  CASE (MenuItemSelected = "LoadTrans") : PLAY "CONVERT"
  CASE (MenuItemSelected = "RunTrans") : PLAY "TICKETS"
  CASE (MenuItemSelected = "PrnXion") : PLAY "PRNTRANS"
  CASE (MenuItemSelected = "FinalPay") : PLAY "FINLTICK"
  CASE (MenuItemSelected = "DropProc") : PLAY "DROP"
  CASE (MenuItemSelected = "MeterProc") : PLAY "METERS"
  CASE (MenuItemSelected = "MnmProc") : PLAY "DAILY"
  CASE (MenuItemSelected = "StartNew") : PLAY "NEWDAY"
  CASE (MenuItemSelected = "ModMnm") : PLAY "INPUT"
  CASE (MenuItemSelected = "ReconRun") : PLAY "TABRECON"
  CASE (MenuItemSelected = "ModGames") : PLAY "CHANGE"
  CASE (MenuItemSelected = "UpMaster") : PLAY "UPDATE"
  CASE (MenuItemSelected = "TdTotal") : PLAY "TOTALTD"
  CASE (MenuItemSelected = "SumRun") : PLAY "RUNSUM"
  CASE (MenuItemSelected = "StatRun") : PLAY "CYOTRUN"
  CASE (MenuItemSelected = "FlagRun") : PLAY "FLAG"
  CASE (MenuItemSelected = "IncLook") : PLAY "LOOKINC"
  CASE (MenuItemSelected = "TotLook") : PLAY "LOOKTOT"
  CASE (MenuItemSelected = "MacLook") : PLAY "LOOKMAS"
  CASE (MenuItemSelected = "ExitPar") : QUITLOOP
  CASE (MenuItemSelected = "Exit/Yes1") : EXIT
ENDSWITCH
```

```
ENDWHILE
;*************************************************************************
```

A:\outstat.sc Page 1

```
;*********************************************************************
;OUTSTAT.SC sends machine income status report to the printer.
;Copyright 1995 New Gaming Systems Inc.
;*********************************************************************
{Report} {Output} {CYOTPCNT} {3} {Printer} {Scripts} {End-Record}
```

A:\prep1.sc Page 1

```
;*********************************************************************
;PREP1.SC prompts users for beginning and ending dates for various reports
;Copyright 1995 New Gaming Systems Inc.
;*********************************************************************

GOOD=0
CLEARALL
EMPTY "ASKEM"
EDIT "ASKEM"
PICKFORM "F"
WAIT RECORD
PROMPT"Enter Beginning Date and Ending Date for Report then press F2"
UNTIL "F2"
DO_IT!
IF NOT ISEMPTY("ASKEM") THEN
  IF (NOT ISBLANK([Beginning Date])) AND (NOT ISBLANK([Ending Date])) THEN
     GOOD=1
     BEGDAT=[Beginning Date]
     ENDDAT=[Ending Date]
     ACCNUM=1
  ELSE
    MESSAGE "NEED BEGINNING AND ENDING DATES..."
  ENDIF
ENDIF
CLEARALL
```

A:\prntit.sc Page 1

```
;*********************************************************************
;PRNTIT.SC prints individual transaction report.
;Copyright 1995 New Gaming Systems Inc.
;*********************************************************************


{Report} {Design}
TYPEIN THEFILE
ENTER
{R} {Replace}
TYPEIN "TRANSACTION REPORT FOR "
TYPEIN CASHNAME
ENTER
{Tabular} Do_It! Esc {Report} {Output}
TYPEIN THEFILE
ENTER
{R} {Printer}
{Scripts} {End-Record}
```

A:\prntrans.sc Page 1

```
;*******************************************************************
;PRNTRANS.SC invokes PRNTIT.SC
;Copyright 1995 New Gamining Systems Inc.
;*******************************************************************


CLEAR
@10,15
??"Enter Cashier Number"
ACCEPT "N" TO CASHNUM
VIEW "CASHIER"
SCAN
IF [Cashier Number]=CASHNUM THEN
  CASHNAME=[Cashier Name]
  THEFILE=[File Name]
ENDIF
ENDSCAN
PLAY "PRNTIT"
CLEAR
CLEARALL
RELEASE VARS ALL
RELEASE PROCS ALL
```

A:\runsum.sc Page 1

```
;*********************************************************************
;RUNSUM.SC runs a periodic machine summary report.
;Copyright 1995 New Gaming Systems Inc.
;*********************************************************************



IN=0
OUT=0
VIEW "SUMFILE"
SCAN
IN=IN+[HANDLE]
OUT=OUT+[PAYOUTS]
EDIT "SUMFILE"
[WIN]=[HANDLE]-[PAYOUTS]
[PAYOUT PERCENT]=100*([PAYOUTS]/[HANDLE])
DO_IT!
ENDSCAN
EDIT "SUMFILE"
END DOWN DOWN
[HANDLE]=IN
[PAYOUTS]=OUT
[WIN]=IN-OUT
[PAYOUT PERCENT]=100*(OUT/IN)
DO_IT!
```

A:\senday.sc Page 1

```
;*********************************************************************
;SENDAY.SC
;Copyright 1995 New Gaming Systems Inc.
;*********************************************************************

{Report} {Change} {DAILY} {R} {DAILY METER READING AND DROP REPORT}
Down Down Down Down Down Down Right Right Right Right Right
Right Right Right Right Right Right Right Right Right Right
Right Right Right Right Right Right Right Right Right Right
Right Right Right Right Right Right Right Right Right Right
Right
TYPEIN COLDAT
TYPEIN "  "
 Do_It! {Report} {Output} {DAILY} {R} {Printer}
{Scripts} {End-Record}
```

A:\senddrop.sc Page 1

```
;*********************************************************************
;SENDDROP.SC
;Copyright 1995 New Gaming Systems Inc.
;*********************************************************************

{Report} {Design} {DROPREP} {R} {Replace}
TYPEIN "DAILY DROP REPORT "
TYPEIN COLDAT
ENTER
{Tabular} Do_It! Esc {Report} {Output} {DROPREP} {R} {Printer}
{Scripts} {End-Record}
```

A:\sendit.sc Page 1

```
;*********************************************************************
;SENDIT.SC
;Copyright 1995 New Gaming Systems Inc.
;*********************************************************************

IF PRINTERSTATUS() = True THEN
  MESSAGE "PRINTING..."
  {Report} {Output} {TEMPREC} {2} {Printer} {Scripts} {End-Record}
  MESSAGE "PRINTING COMPLETE...RECONCILIATION COMPLETE"
  ELSE MESSAGE "THE PRINTER IS NOT READY"
ENDIF
```

A:\sendrep.sc Page 1

```
;*************************************************************************
;SENDREP.SC
;Copyright 1995 New Gaming Systems Inc.
;*************************************************************************

{Report} {Design} {SHIFTREP} {2} {Replace}
TYPEIN "SHIFT REPORT-"
TYPEIN CASHNAME
ENTER
{Tabular} Do_It! Esc {Report} {Output} {SHIFTREP} {2} {Printer}
{Scripts} {End-Record}
```

A:\sendrep2.sc Page 1

```
;*********************************************************************
;SENDREP2.SC
;Copyright 1995 New Gaming Systems Inc.
;*********************************************************************

{Report} {Design} {SHIFTREP} {2} {Replace}
TYPEIN "CLOSING PAYOUT REPORT"
ENTER
{Tabular} Do_It! Esc {Report} {Output} {SHIFTREP} {2} {Printer}
{Scripts} {End-Record}
```

A:\sendsum.sc Page 1

```
;*****************************************************************
;SENDSUM.SC
;Copyright 1995 New Gaming Systems Inc.
;*****************************************************************

Menu {Report} {Change} {CASHREP} {R} {CLOSING CASHIER SUMMARY}
Down Down Down Down Down Down Right Right Right Right Right
Right Right Right Right Right Right Right Right Right Right
Right Right Right Right Right Right Right Right Right Right
Right Right Right Right Right Right Right Right Right Right
TYPEIN COLDAT
Do_It!
Menu {Report} {Output} {CASHREP} {R} {Printer}
Menu {Scripts} {End-Record}
```

A:\sortdrop.sc Page 1

```
;*********************************************************************
;SORTDROP.SC sorts the drop file by machine number.
;Copyright 1995 New Gaming Systems Inc.
;*********************************************************************

Menu {Modify} {Sort} {DROPTAB} {Same}  "1" Do_It!
Menu {Scripts} {End-Record}
```

A:\sortflag.sc Page 1

```
;*********************************************************************
;SORTFLAG.SC sorts flag report by machine.
;Copyright 1995 New Gaming Systems Inc.
;*********************************************************************


Menu {Modify} {Sort} {Flagrep} {Same} Down Down  "1" Do_It!
Menu {Scripts} {End-Record}
```

A:\summary.sc Page 1

```
;*********************************************************************
;SUMMARY.SC invokes the RUNSUM.SC
;Copyright 1995 New Gaming Systems Inc.
;*********************************************************************


PROC TABIT(DAT,RCI,RCO,RGP,PCNT)
  EDIT "SUMFILE"
  END DOWN
  [DATE]=DAT
  [HANDLE]=RCI
  [PAYOUTS]=RCO
  [WIN]=RGP
  [PAYOUT PERCENT]=PCNT
;  [NGS-NET]=NGS
  DO_IT!
  UPIMAGE
ENDPROC

EMPTY "SUMFILE"
PLAY "PREP1"
IF GOOD=1 THEN
  CLEAR
  MESSAGE BEGDAT," ",ENDDAT," ",ACCNUM
  SLEEP 2000
  VIEW "LOCATION"
  SCAN FOR ACCNUM=[ACCOUNT-#]
    MASFILE=[MASTER TABLE]
    LOC=[LOCATION]
    DATFILE=[REPORT FILE]
  ENDSCAN
  CLEARALL
;  MESSAGE LOC," ",MASFILE," ",DATFILE
;  SLEEP 2000
  DATONE=(BEGDAT-1)
  DATTWO=(ENDDAT+1)
  MESSAGE "RUNNING SUMMARY..."
  VIEW "TOTREP"
    SCAN
      IF ([DATE]>DATONE) AND ([DATE]<DATTWO) THEN
          DAT=[DATE]
          RCI=[REAL-CASH-IN]
          RCO=[REAL-CASH-OUT]
          RGP=[REAL-GROSS-PROFIT]
          PCNT=100*(RCO/RCI)
;          NGS=[NGS-NET]
          TABIT(DAT,RCI,RCO,RGP,PCNT)

      ENDIF
    ENDSCAN
ENDIF
CLEARALL
```

A:\summary.sc Page 2

```
CLEAR
PLAY "DEL2ND"
PLAY "RUNSUM"
PLAY "SUMSEND"
CLEARALL
CLEAR
RELEASE VARS ALL
RELEASE PROCS ALL
```

A:\sumsend.sc Page 1

```
;*********************************************************************
;SUMSEND.SC
;Copyright 1995 New Gaming Systems Inc.
;*********************************************************************

{Report} {Output} {SUMFILE} {1} {Printer}
```

A:\tabrecon.sc Page 1

```
;*********************************************************************
;TABRECON.SC runs a daily reconciliation.
;Copyright 1995 New Gaming Systems Inc.
;*********************************************************************



EMPTY "TEMPREC"

PROC PROMPTTHEDUDE()
  CLEAR
  @10,15
ENDPROC

PROC ETAB(ACCNUM,COLDAT,LOC,EQUIP,NCOINSIN,NCOINSOUT,CASHIN,CASHOUT,PROFIT,RCI,R

  EDIT "TEMPREC"
  IF NOT ISEMPTY("TEMPREC") THEN
    END
    DOWN
  ENDIF
  [DATE]=COLDAT
  [LOCATION]=LOC
  [MACHINE]=EQUIP
  [COINS-IN]=NCOINSIN
  [COINS-OUT]=NCOINSOUT
  [MONEY-IN]=CASHIN
  [MONEY-OUT]=CASHOUT
  [GROSS-PROFIT]=PROFIT
  [REAL-CASH-IN]=RCI
  [REAL-CASH-OUT]=RCO
  [REAL-GROSS-PROFIT]=RGP
  [JACKPOTS]=JP
  [OVER/UNDER]=DIFF
;  [NGS-NET]=JACKS
  DO_IT!
  UPIMAGE
ENDPROC

PROMPTTHEDUDE()
??"ENTER PASSWORD? "
ACCEPT "A5" TO PW
IF PW="OU812" THEN
  TOTMI=0
  TOTMO=0
  TOTGP=0
  TOTRCI=0
  TOTRCO=0
  TOTRGP=0
  TOTJP=0
```

A:\tabrecon.sc Page 2

```
  TOTDIFF=0
;  TOTJACKS=0
  L=0
  I=1
  PROMPTTHEDUDE()
  ??"ENTER THE RECONCILIATION DATE IN FORM mm/dd/yy "
  ACCEPT "D" TO COLDAT
  PROMPTTHEDUDE()
  ACCNUM=1
  VIEW "LOCATION"
  SCAN
    IF [ACCOUNT-#]=ACCNUM THEN
      MASFILE=[MASTER TABLE]
      PLACE=[LOCATION]
      PCT=[PERCENT]
    ENDIF
  ENDSCAN
  N=NRECORDS(MASFILE)
  K=1
  W=N
  ARRAY MACH[N]
  ARRAY COINSI[N]
  ARRAY COINSO[N]
  ARRAY GAMESW[N]
  ARRAY GAMESP[N]
  ARRAY CIM[W]
  ARRAY COM[W]
  ARRAY MCOLL[W]
  ARRAY MPAID[W]
  ARRAY JPAID[W]
  M=1
  VIEW "M&M"
  MESSAGE "PROCESSING RECONCILIATION"
  SLEEP 1500
  SCAN
    CIM[M]=[M&M->COINSIN]
    COM[M]=[M&M->COINSOUT]
    MCOLL[M]=[M&M->AMT-COLLECTED]
    MPAID[M]=[M&M->AMT-PAID]
    JPAID[M]=[M&M->JACKPOTS]
    M=M+1
  ENDSCAN
  CLEARALL
  VIEW MASFILE
  SCAN
    IF ACCNUM=[ACCOUNT-#] THEN
      L=L+1
      ODATE={DATE}
      LOC=[LOCATION]
      EQUIP=[EQUIPMENT]
      MACH[I]=EQUIP
      ID=[ID-#]
```

A:\tabrecon.sc Page 3

```
      OCOINSIN=[COINSIN]
      OCOINSOUT=[COINSOUT]
      DENOMIN=[DENOM-IN]
      DENOMOUT=[DENOM-OUT]
      GW=[GAMES-WON]
      GP=[GAMES-PLAYED]
      NCOINSIN=CIM[L]
        IF NCOINSIN=0 THEN
           NCOINSIN=OCOINSIN
        ENDIF
      COINSI[I]=NCOINSIN
      NCOINSOUT=COM[L]
        IF NCOINSOUT=0 THEN
           NCOINSOUT=OCOINSOUT
        ENDIF
      COINSO[I]=NCOINSOUT
      NGW=0
      GAMESW[I]=NGW
      NGP=0
      GAMESP[I]=NGP
      DIFF1=NCOINSIN-OCOINSIN
      DIFF2=NCOINSOUT-OCOINSOUT
      CASHIN=DIFF1*DENOMIN
      CASHOUT=DIFF2*DENOMOUT
      PROFIT=CASHIN-CASHOUT
      RCI=MCOLL[L]
      RCO=MPAID[L]
      RGP=RCI-RCO
      JACKS=RGP*PCT
      DIFF=RGP-PROFIT
      JP=0
      ETAB(ACCNUM,COLDAT,LOC,EQUIP,NCOINSIN,NCOINSOUT,CASHIN,CASHOUT,PROFIT,RCI,
      TOTMI=TOTMI+CASHIN
      TOTMO=TOTMO+CASHOUT
      TOTGP=TOTGP+PROFIT
      TOTRCI=TOTRCI+RCI
      TOTRCO=TOTRCO+RCO
      TOTRGP=TOTRGP+RGP
      TOTJP=TOTJP+JP
      TOTDIFF=TOTDIFF+DIFF
;      TOTJACKS=TOTJACKS+JACKS
    ENDIF
    I=I+1
  ENDSCAN
  EDIT "TEMPREC"
  END
  DOWN
  [DATE]=COLDAT
  [LOCATION]="TOTALS"
  [MACHINE]="Z"
  [COINS-IN]=0
  [COINS-OUT]=0
```

A:\tabrecon.sc Page 4

```
  [MONEY-IN]=TOTMI
  [MONEY-OUT]=TOTMO
  [GROSS-PROFIT]=TOTGP
  [REAL-CASH-IN]=TOTRCI
  [REAL-CASH-OUT]=TOTRCO
  [REAL-GROSS-PROFIT]=TOTRGP
  [JACKPOTS]=TOTJP
  [OVER/UNDER]=TOTDIFF
;  [NGS-NET]=TOTJACKS
  DO_IT!
  UPIMAGE
  EDIT "TOTREP"
  END
  [DATE]=COLDAT
  [COMMENTS]="TOTALS    "
  [LOCATION-#]=ACCNUM
  [MONEY-IN]=TOTMI
  [MONEY-OUT]=TOTMO
  [GROSS-PROFIT]=TOTGP
  [REAL-CASH-IN]=TOTRCI
  [REAL-CASH-OUT]=TOTRCO
  [REAL-GROSS-PROFIT]=TOTRGP
  [JACKPOTS]=TOTJP
  [OVER/UNDER]=TOTDIFF
;  [NGS-NET]=TOTJACKS
  DO_IT!
  UPIMAGE
  EMPTY "TABUP"
  EDIT "TABUP"
  FOR J FROM K TO N
    [DATE]=COLDAT
    [MACHINE]=MACH[J]
    [COINSIN]=COINSI[J]
    [COINSOUT]=COINSO[J]
    [GAMES-W]=GAMESW[J]
    [GAMES-P]=GAMESP[J]
    DOWN
  ENDFOR
  DO_IT!
  UPIMAGE
ENDIF
CLEARALL
PLAY "DELFIRST"
CLEARALL
PLAY "SENDIT"
CLEARALL
RELEASE VARS ALL
RELEASE PROCS ALL
CLEAR
```

A:\theanls.sc Page 1

```
;*********************************************************************
;THEANLS.SC runs analysis by machine type
;Copyright 1995 New Gaming Systems Inc.
;*********************************************************************

W=NRECORDS("TYPE")
ARRAY KIND[W]
ARRAY NUMOF[W]
A=1.
VIEW "TYPE"
SCAN
KIND[A]=[MACHINE-TYPE]
NUMOF[A]=[NUMBER]
MESSAGE A," ",KIND[A],"  ",NUMOF[A]
SLEEP 900
A=A+1
ENDSCAN
CLEARALL
CLEAR
;*******************************************************************
EMPTY "CYOTANLS"
FOR K FROM 1 TO W


TOTDIN=0
TOTDOUT=0
TOTWIN=0
TOTWOUT=0
TOTMIN=0
TOTMOUT=0
TOTYIN=0
TOTYOUT=0
VIEW "CYOTPCNT"
SCAN

IF [Type]=KIND[K] THEN

DAT=[Date]
ID=[ID-#]
DH=[Daily-Handle]
DP=[Daily-Payout]
TOTDIN=TOTDIN+DH
TOTDOUT=TOTDOUT+DP
WH=[Weekly-Handle]
WP=[Weekly-Payout]
TOTWIN=TOTWIN+WH
TOTWOUT=TOTWOUT+WP
MH=[Monthly-Handle]
MP=[Monthly-Payout]
TOTMIN=TOTMIN+MH
TOTMOUT=TOTMOUT+MP
```

A:\theanls.sc Page 2

```
YH=[Yearly-Handle]
YP=[Yearly-Payout]
TOTYIN=TOTYIN+YH
TOTYOUT=TOTYOUT+YP

EDIT "CYOTANLS"
END DOWN
[Date]=DAT
[Type]=KIND[K]
[ID-#]=ID
[Daily-Handle]=DH
[Daily-Payout]=DP
[Daily-Win]=DH-DP
[Daily-Percent]=100*(DP/DH)
[Weekly-Handle]=WH
[Weekly-Payout]=WP
[Weekly-Win]=WH-WP
[Weekly-Percent]=100*(WP/WH)
[Monthly-Handle]=MH
[Monthly-Payout]=MP
[Monthly-Win]=MH-MP
[Monthly-Percent]=100*(MP/MH)
[Yearly-Handle]=YH
[Yearly-Payout]=YP
[Yearly-Win]=YH-YP
[Yearly-Percent]=100*(YP/YH)
DO_IT!
UPIMAGE
ENDIF
ENDSCAN
CLEARALL
;*******************************************************************

EDIT "CYOTANLS"
END DOWN DOWN

[Date]=DAT
[Type]="Totals"
[Daily-Handle]=TOTDIN
[Daily-Payout]=TOTDOUT
[Daily-Win]=TOTDIN-TOTDOUT
[Daily-Percent]=100*(TOTDOUT/TOTDIN)
[Weekly-Handle]=TOTWIN
[Weekly-Payout]=TOTWOUT
[Weekly-Win]=TOTWIN-TOTWOUT
[Weekly-Percent]=100*(TOTWOUT/TOTWIN)
[Monthly-Handle]=TOTMIN
[Monthly-Payout]=TOTMOUT
[Monthly-Win]=TOTMIN-TOTMOUT
[Monthly-Percent]=100*(TOTMOUT/TOTMIN)
[Yearly-Handle]=TOTYIN
[Yearly-Payout]=TOTYOUT
```

```
[Yearly-Win]=TOTYIN-TOTYOUT
[Yearly-Percent]=100*(TOTYOUT/TOTYIN)

DOWN
[Type]="Per-Game"
DOWN
[Type]="Average"
[Daily-Handle]=TOTDIN/NUMOF[K]
[Daily-Payout]=TOTDOUT/NUMOF[K]
[Daily-Win]=(TOTDIN-TOTDOUT)/NUMOF[K]
[Daily-Percent]=100*(TOTDOUT/TOTDIN)
[Weekly-Handle]=TOTWIN/NUMOF[K]
[Weekly-Payout]=TOTWOUT/NUMOF[K]
[Weekly-Win]=(TOTWIN-TOTWOUT)/NUMOF[K]
[Weekly-Percent]=100*(TOTWOUT/TOTWIN)
[Monthly-Handle]=TOTMIN/NUMOF[K]
[Monthly-Payout]=TOTMOUT/NUMOF[K]
[Monthly-Win]=(TOTMIN-TOTMOUT)/NUMOF[K]
[Monthly-Percent]=100*(TOTMOUT/TOTMIN)
[Yearly-Handle]=TOTYIN/NUMOF[K]
[Yearly-Payout]=TOTYOUT/NUMOF[K]
[Yearly-Win]=(TOTYIN-TOTYOUT)/NUMOF[K]
[Yearly-Percent]=100*(TOTYOUT/TOTYIN)
DOWN
[Type]="*********"
DO_IT!

CLEARALL
CLEAR
;*******************************************************************

ENDFOR
CLEARALL
CLEAR
PLAY "DEL4TH"
MESSAGE "Sending type analysis report to printer..."

PLAY "OUTANLS"
MESSAGE "Report complete......"
RELEASE VARS ALL
RELEASE PROCS ALL
```

A:\tickets.sc Page 1

```
;*********************************************************************
;TICKETS.SC processes audited cashier voucher information.
;Copyright 1995 New Gaming Systems Inc.
;*********************************************************************



PROC THEPROMPT()
   CLEAR
   @10,15
ENDPROC


THEPROMPT()
??"Enter Cashier Number "
ACCEPT "N" TO CASHNUM
VIEW "CASHIER"
SCAN
IF [Cashier Number]=CASHNUM THEN
  EDTFILE=[File Name]
  CASHNAME=[Cashier Name]
ENDIF
ENDSCAN
CLEAR
CLEARALL
EDIT EDTFILE

WAIT TABLE
PROMPT "Enter Machine Numbers and Cash Amounts then press F2 when finished"
UNTIL "F2"
DO IT!
CLEARALL
CLEAR
Z=NRECORDS("COYOTE")

ARRAY NUMTICKS[Z]
ARRAY PAYOUT[Z]
FOR I FROM 1 TO Z
  NUMTICKS[I]=0
  PAYOUT[I]=0
ENDFOR


  VIEW EDTFILE
  SCAN
  K=[MACHINE-#]
    PAYOUT[K]=PAYOUT[K]+[PAYOUT]
    NUMTICKS[K]=NUMTICKS[K]+1
    MESSAGE "PROCESSING DATA..."
    SLEEP 100
```

```
  ENDSCAN
  CLEARALL

EMPTY "ENDSHIFT"
EDIT "ENDSHIFT"
FOR L FROM 1 TO Z
  [Machine-#]=L
  [Number of Tickets]=NUMTICKS[L]
  [Amount-Paid]=PAYOUT[L]
  DOWN
ENDFOR
DO_IT!
EMPTY "SHIFTREP"
ADD "ENDSHIFT" "SHIFTREP"
CLEARALL
TOTTICKS=0
TOTPAY=0
VIEW "SHIFTREP"
SCAN
  TOTTICKS=TOTTICKS+[Number of Tickets]
  TOTPAY=TOTPAY+[Amount-Paid]
ENDSCAN
EDIT "SHIFTREP"
END DOWN
[Number of Tickets]=TOTTICKS
[Amount-Paid]=TOTPAY
DO_IT!
CLEARALL
VIEW "CASHREP"
SCAN
IF [Cashier Number]=CASHNUM THEN
  EDIT "CASHREP"
  [Number Tickets]=TOTTICKS
  [Total Payouts]=TOTPAY
  DO_IT!
ENDIF
ENDSCAN
CLEARALL
@10,15
??"Print Voucher Report Y/N ? "
ACCEPT "A1" TO PRNTANS
IF PRNTANS="Y" OR PRNTANS="y" THEN
  PLAY "SENDREP"
ENDIF
CLEARALL
CLEAR

RELEASE PROCS ALL
RELEASE VARS ALL
```

A:\totaltd.sc Page 1

```
;*********************************************************************
;TOTALTD.SC runs totals to date.
;Copyright 1995 New Gaming Systems Inc.
;*********************************************************************


MESSAGE "RUNNING TOTALS..."
TOTMI=0
TOTMO=0
TOTGP=0
TOTRCI=0
TOTRCO=0
TOTRGP=0
TOTJP=0
TOTDIFF=0
TOTJACKS=0

VIEW "TOTREP"
SCAN

TOTMI=TOTMI+[MONEY-IN]
TOTMO=TOTMO+[MONEY-OUT]
TOTGP=TOTGP+[GROSS-PROFIT]
TOTRCI=TOTRCI+[REAL-CASH-IN]
TOTRCO=TOTRCO+[REAL-CASH-OUT]
TOTRGP=TOTRGP+[REAL-GROSS-PROFIT]
TOTJP=TOTJP+[JACKPOTS]
TOTDIFF=TOTDIFF+[OVER/UNDER]
;TOTJACKS=TOTJACKS+[NGS-NET]
ENDSCAN

EDIT "TOTREP"
END
DOWN

[COMMENTS]="TOTALS TO DATE "

[MONEY-IN]=TOTMI
[MONEY-OUT]=TOTMO
[GROSS-PROFIT]=TOTGP
[REAL-CASH-IN]=TOTRCI
[REAL-CASH-OUT]=TOTRCO
[REAL-GROSS-PROFIT]=TOTRGP
[JACKPOTS]=TOTJP
[OVER/UNDER]=TOTDIFF
;[NGS-NET]=TOTJACKS
DO_IT!

UPIMAGE
CLEARALL
CLEAR
```

A:\totaltd.sc Page 2

```
MESSAGE "TOTALS COMPLETE..."
RELEASE VARS ALL
RELEASE PROCS ALL
```

A:\update.sc Page 1

```
;*******************************************************************
;UPDATE.SC updates machine master file after reconciliation.
;Copyright 1995 New Gaming Systems Inc.
;*******************************************************************


ADD "TEMPREC" "TABREP1"
CLEARALL
ACCNUM=1
CLEAR
MESSAGE "UPDATING MASTER FILE..."
SLEEP 1500
VIEW "TABUP"


SCAN
DAT=[TABUP->DATE]
MACH=[TABUP->MACHINE]
COIN=[TABUP->COINSIN]
COOUT=[TABUP->COINSOUT]
GAW=[TABUP->GAMES-W]
GAP=[TABUP->GAMES-P]
IF ACCNUM=1 THEN
  EDIT "COYOTE"
ENDIF
[DATE]=DAT
[EQUIPMENT]=MACH
[COINSIN]=COIN
[COINSOUT]=COOUT
[GAMES-WON]=GAW
[GAMES-PLAYED]=GAP
DOWN
DO IT!
UPIMAGE
ENDSCAN
CLEARALL
CLEAR
MESSAGE "UPDATE COMPLETE..."
RELEASE VARS ALL
RELEASE PROCS ALL
CLEAR
```

A:\weekzip.sc Page 1

```
;*********************************************************************
;WEEKZIP.SC clears weekly totals.
;Copyright 1995 New Gaming Systems Inc.
;*********************************************************************

W=NRECORDS("CYOTPCNT")
EDIT "CYOTPCNT"
FOR K FROM 1 TO W
  [Weekly-Handle]=0
  [Weekly-Payout]=0
  [Weekly-Win]=0
  [Weekly-Percent]=0
  DOWN
ENDFOR
DO_IT!
```

A:\yearzip.sc Page 1

```
;*********************************************************************
;YEARZIP.SC clears years machine totals.
;Copyright 1995 New Gaming Systems Inc.
;*********************************************************************


W=NRECORDS("CYOTPCNT")
EDIT "CYOTPCNT"
FOR K FROM 1 TO W
  [Yearly-Handle]=0
  [Yearly-Payout]=0
  [Yearly-Win]=0
  [Yearly-Percent]=0
  DOWN
ENDFOR
DO_IT!
```

We claim:

1. An apparatus for collecting and processing transactions from electronic gaming machines, comprising:

(a) cashier station means for entering, viewing and modifying payout information;

(b) cage server means for accumulating said payout information;

(c) network communications means for providing data communications between said cashier station means and said cage server means;

(d) vault station means for accumulating income information;

(e) slot accounting station means for auditing, reconciling and storing said payout and said income information; and (f) communications interface means for providing data communications between said slot accounting station means and said vault station means and between said slot accounting station means and said cage server means.

2. An apparatus as recited in claim 1, further comprising:

(a) cashier software layer means executed on said cage server means for providing access to a plurality of functional sublayers;

(b) drop software layer means executed on either said vault station means or said cage server means for counting a drop per machine; and (c) slot accounting software layer means for assimilating, verifying, reconciling and reporting data collected in said cage server means and said vault station means.

3. An apparatus as recited in claim 2, wherein said cashier software layer means includes tickets, bank, printouts and manager software sublayers, wherein said drop software layer means includes input, lookup, report and close software sublayers, and wherein said slot accounting software layer means includes tickets, income, reconcile, output and lookup software sublayers.

4. An apparatus for gaming machine transaction accounting, comprising:

(a) a plurality of programmed data processors, at least one of said programmed data processors comprising a network server;

(b) user interface means for accessing said programmed data processors;

(c) network communications means for providing data communications between said network server and at least a said one of said other programmed data processors;

(d) at least one of said programmed data processors including means for entry of a gaming machine payout voucher redeemed by a customer;

(e) at least one of said programmed data processors including means for entry of drop currency amounts for a gaming machine; and (f) at least one of said programmed data processors including means for auditing said payout vouchers.

5. An apparatus as recited in claim 4, wherein at least one of said programmed data processors comprises a cashier station, wherein at least one of said programmed data processors comprises a drop station, and wherein at least one of said programmed data processors comprises a slot accounting station, said cashier station coupled to said network server.

6. An apparatus as recited in claim 5, further comprising:

(a) cashier software means operative from said cashier station for adding up and manually entering vouchers as they are being redeemed by customers, for looking up transactions and modifying any errors made during entry, for updating the balance of a cash drawer, for manually entering any cash fills to said cash drawer, for entering any table chips that redeemed by customers, for acquiring a transaction report or a voucher report, for generating day, swing and graveyard reports for a cashier, and for generating an end of business day report;

(b) drop software means operative from said vault station for manually inputting drop currency amounts for a slot machine, for calculating and recording totals, for looking up daily totals for a slot machine, for printing a report on machine drop activity for the current days work, for saving the days drop activity to a file and zeroes out totals for the next days processing; and (c) slot accounting software means operative from said slot accounting station for loading transaction files across said network communications means from said cashier station, for auditing payout vouchers, for providing final daily reports on payout activity, for loading a daily drop file from across said network communications means, for inputting meter readings from a slot machine, for generating a daily drop report, for generating a critical table of daily meter readings, drop, payout and net amount for a slot machine, for loading said critical table and previous days meter readings, for generating a reconciliation report, for generating a periodic summary report, a machine income status report, an analysis report giving income information by slot machine type, denomination or by banks of slot machines, and a slot machine flag report flagging a losing slot machines over a specified period of time, and for looking up slot machine income, daily totals or viewing the slot machine master file.

7. An electronic gaming transaction accounting apparatus, comprising:

(a) cashier station means for entering, viewing and modifying payout information;

(b) a cage server, said cage server including cashier software means operative from said cashier station for adding up and manually entering vouchers as they are being redeemed by customers, means for looking up transactions and modifying any errors made during entry, means for updating the balance of a cash drawer, means for manually entering any cash fills to said cash drawer, means for entering any table chips that redeemed by customers, means for acquiring a transaction report or a voucher report, means for generating day, swing and graveyard reports for a cashier, and means for generating an end of business day report;

(c) network communications means for providing data communications between said cashier station and said cage server;

(d) a vault station, said vault station including drop software means for manually inputting drop currency amounts for a slot machine, means for calculating and recording totals, means for looking up daily totals for a slot machine, means for printing a report on machine drop activity for the current days work, means for saving the days drop activity to a file and zeroes out totals for the next days processing;

(e) a slot accounting station, said slot accounting station including slot accounting software means for loading transaction files across said network communications means from said cashier station, means for auditing payout vouchers, means for providing final daily reports on payout activity, means for loading a daily drop file from across said network communications means, means for inputting meter readings from a slot machine, means for generating a daily drop report, means for generating a critical table of daily meter readings, drop, payout and net amount for a slot machine, means for loading said critical table and previous days meter readings, means for generating a reconciliation report, means for generating a periodic summary report, a machine income status report, an analysis report giving income information by slot machine type, denomination or by banks of slot machines, and a slot machine flag report flagging a losing slot machines over a specified period of time, means for looking up slot machine income, daily totals or viewing the slot machine master file; and (f) communications interface means for providing data communications between said slot accounting station and said vault station and between said slot accounting station and said cage server.

* * * * *